US007909670B2

(12) United States Patent
Suzuki et al.

(10) Patent No.: US 7,909,670 B2
(45) Date of Patent: Mar. 22, 2011

(54) MARINE PROPULSION SYSTEM

(75) Inventors: Takayoshi Suzuki, Shizuoka (JP); Daisuke Nakamura, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 177 days.

(21) Appl. No.: 12/372,781

(22) Filed: Feb. 18, 2009

(65) Prior Publication Data

US 2009/0209144 A1 Aug. 20, 2009

(30) Foreign Application Priority Data

Feb. 18, 2008 (JP) ..... 2008-036236

(51) Int. Cl.
*B60W 10/04* (2006.01)
*B63H 21/21* (2006.01)

(52) U.S. Cl. ..... 440/86

(58) Field of Classification Search ..... 440/1, 49, 440/75, 80, 81, 84, 86, 87
See application file for complete search history.

(56) References Cited

U.S. PATENT DOCUMENTS

| | | | | |
|---|---|---|---|---|
| 5,601,464 | A * | 2/1997 | Ogino et al. | 440/75 |
| 5,711,742 | A * | 1/1998 | Leinonen et al. | 477/121 |
| 5,888,108 | A | 3/1999 | Iriono | |
| 6,582,259 | B1 * | 6/2003 | Mansson et al. | 440/75 |
| 7,458,866 | B2 * | 12/2008 | Nakamura et al. | 440/75 |
| 7,762,858 | B2 * | 7/2010 | Suzuki et al. | 440/1 |

FOREIGN PATENT DOCUMENTS

JP 09-263294 A 10/1997

* cited by examiner

*Primary Examiner* — Daniel V Venne
(74) *Attorney, Agent, or Firm* — Keating & Bennett, LLP

(57) ABSTRACT

A marine propulsion system includes an engine, propellers rotated by the engine, a transmission mechanism arranged to transmit a driving force of the engine to the propellers with a speed thereof shifted to at least a low speed reduction ratio or a high speed reduction ratio in forward travel and reverse travel, and a gear shift switch operable by a user to shift speed reduction ratios of the transmission mechanism to the low speed reduction ratio in at least the reverse travel. This arrangement provides a marine propulsion system in which both of acceleration performance and a maximum speed can approach levels that a user desires.

15 Claims, 13 Drawing Sheets

MARINE PROPULSION SYSTEM

BACKGROUND OF THE INVENTION

1. Field of the Invention

The present invention relates to a marine propulsion system. More specifically, the present invention relates to a marine propulsion system including an engine.

2. Description of the Related Art

Conventionally, marine propulsion units (marine propulsion systems) including an engine are known in the art (for example, see JP-A-Hei 9-263294). JP-A-Hei 9-263294 discloses a marine propulsion unit including an engine and a power transmission mechanism transmitting a driving force of the engine to a propeller in a certain fixed reduction ratio. The marine propulsion unit is constructed such that the driving force of the engine is directly transmitted to the propeller via the power transmission mechanism and the rotational speed of the propeller increases proportionally with an increase in the engine speed.

However, the marine propulsion unit disclosed in JP-A-Hei 9-263294 has a problem in which it is difficult to improve acceleration performance in a low speed position when the speed reduction ratio of the power transmission mechanism is set to achieve a larger maximum speed. Conversely, there is a problem that it is difficult to achieve a larger maximum speed when the reduction ratio of the power transmission mechanism is set to improve the acceleration performance in the low speed position. In other words, the marine propulsion unit disclosed in JP-A-Hei 9-263294 has a problem in which it is difficult for the user to achieve both an acceleration performance and a maximum speed approaching the levels that he/she desires.

SUMMARY OF THE INVENTION

In order to overcome the problems described above, preferred embodiments of the present invention provide a marine propulsion system in which both an acceleration performance and a maximum speed can approach levels that a user desires.

To achieve this, a marine propulsion system in accordance with a preferred embodiment of the present invention includes an engine; a propeller arranged to be rotated by the engine; a transmission mechanism arranged to operate in at least a low speed reduction ratio and a high speed reduction ratio, and arranged to transmit a driving force of the engine to the propeller with a speed thereof shifted to one of the low speed reduction ratio and the high speed reduction ratio during a forward travel and a reverse travel; and an operation portion operable by a user and arranged to shift the speed reduction ratio of the transmission mechanism to the low speed reduction ratio in at least the reverse travel.

As described above, the marine propulsion system in accordance with the above preferred embodiment includes a transmission mechanism arranged to transmit the driving force generated by the engine to the propeller with the speed shifted to one of the low speed reduction ratio and the high speed reduction ratio. The transmission mechanism is arranged such that the driving force generated by the engine can be transmitted to the propeller with the speed shifted to the low speed reduction ratio. Accordingly, an acceleration performance in the low speed position can be improved. Further, the transmission mechanism is constructed such that the driving force generated by the engine can be transmitted to the propeller with the speed shifted to the high speed reduction ratio. This allows a larger maximum speed to be obtained. As a result, both the acceleration performance and the maximum speed can approach levels that the user desires. The user operates the operation portion and thereby can arbitrarily shift the speed reduction ratio of the transmission mechanism to the low speed reduction ratio in the reverse travel.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Preferred embodiments of the present invention will be described hereinafter with reference to the drawings.

Figure 1:
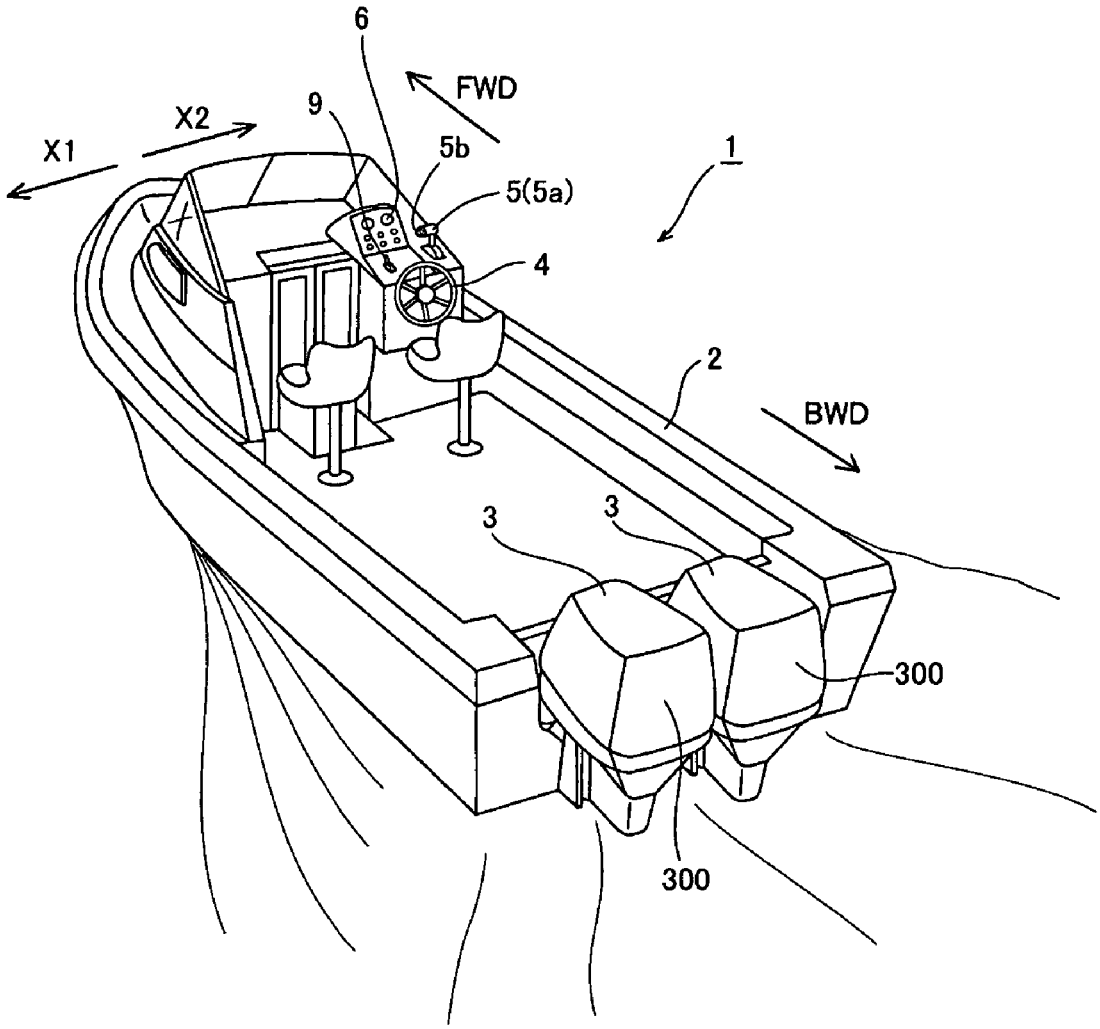
FIG. 1 is a perspective view showing a boat in which a marine propulsion system in accordance with a preferred embodiment of the present invention is installed.
Figure 2:
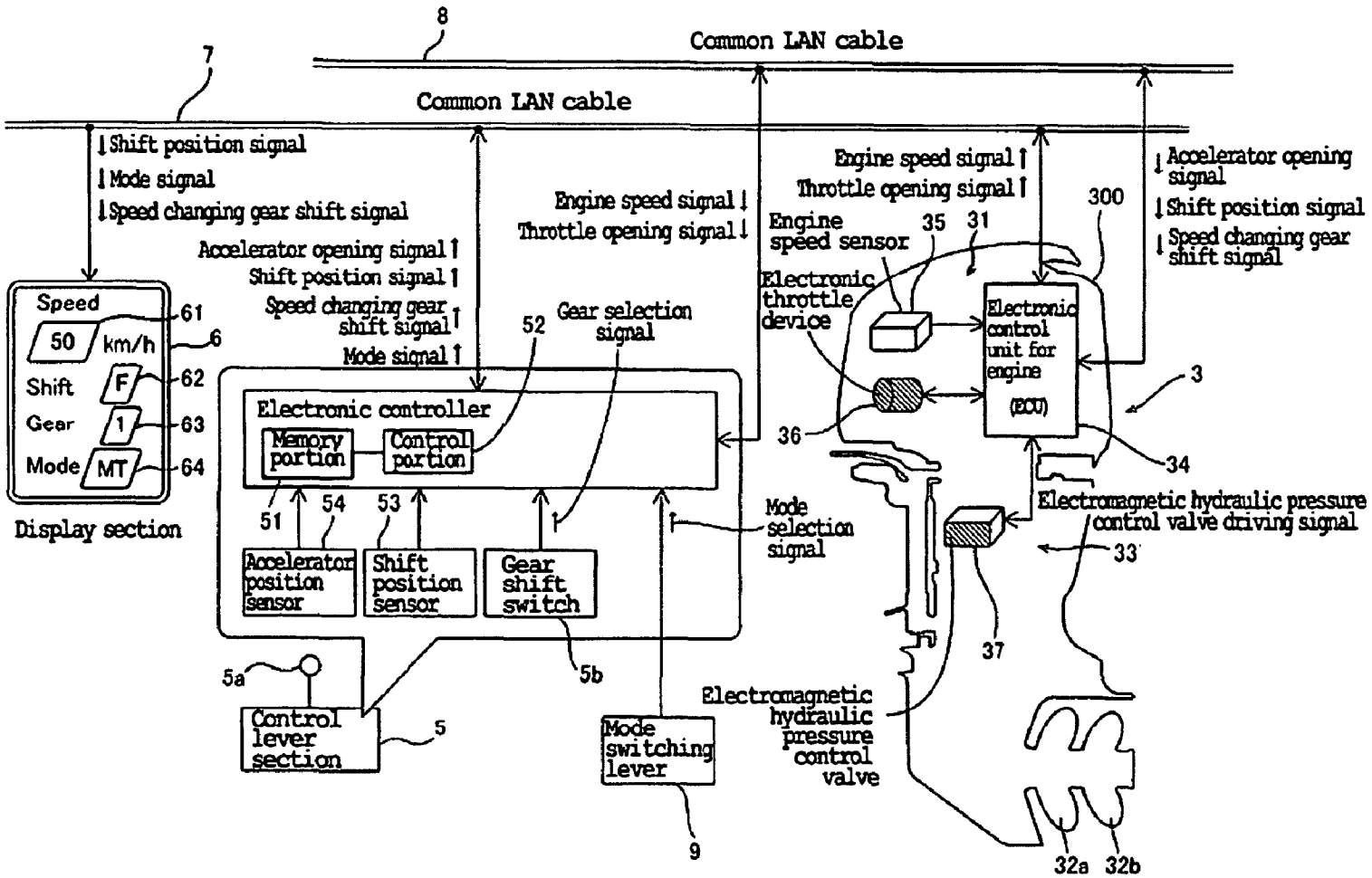
FIG. 2 is a block diagram showing an arrangement of the marine propulsion system in accordance with a preferred embodiment of the present invention.

FIG. 1 is a perspective view showing a boat in which a marine propulsion system in accordance with a preferred embodiment of the present invention is installed. FIG. 2 is a block diagram showing a construction of the marine propulsion system in accordance with a preferred embodiment of the present invention. FIGS. 3 through 9 are drawings specifically illustrating the construction of the marine propulsion system in accordance with the preferred embodiment shown in FIG. 1. In the figures, arrow FWD indicates the forward travel direction of the boat, and arrow BWD indicates the reverse travel direction of the boat. First, the construction of a boat 1 and the marine propulsion system installed in the boat 1 in accordance with a preferred embodiment of the present invention will be described with reference to FIGS. 1 through 9.

As shown in FIG. 1, the boat 1 in accordance with the present preferred embodiment has a hull 2 floating on the water surface, two outboard motors 3 mounted on rear portions of the hull 2 to propel the hull 2, a steering section 4 arranged to steer the hull 2, a control lever section 5 disposed in a vicinity of the steering section 4 and including a lever 5*a* arranged to turn in the fore-and-aft direction, and a display section 6 disposed in a vicinity of the control lever section 5. As shown in FIG. 2, the outboard motors 3, the control lever section 5, and the display section 6 are connected together by each of common LAN cables 7 and 8. In the present preferred embodiment, the boat 1 has a mode switching lever 9 arranged to switch between a manual mode that a user can select a speed reduction ratio and an automatic mode in which the reduction ratio is automatically selected based on operation on the lever 5*a*. The mode switching lever 9 is arranged to turn to an MT position corresponding to the manual mode and an AT position corresponding to the automatic mode. The user turns the mode switching lever 9 to the MT position or the AT position and thereby can select the desired mode. The boat propulsion system is preferably provided with the outboard motors 3, the steering section 4, the control lever section 5, the display section 6, the common LAN cables 7 and 8, and the mode switching lever 9.

As shown in FIG. 1, the two outboard motors 3 are preferably symmetrically disposed with respect to the center in the width direction (directions of arrows X1 and X2) of the hull 2. The outboard motor 3 is covered by a casing 300. The casing 300 is preferably made of resin and has a function to protect the inside of the outboard motor 3 from water and so forth. The outboard motor 3 includes an engine 31, two propellers 32*a* and 32*b* (see FIG. 6) arranged to convert the driving force of the engine 31 into a propulsion force of the boat 1, a transmission mechanism 33 arranged to transmit the driving force generated by the engine 31 to the propellers 32*a* and 32*b* with a speed thereof shifted to a low speed reduction ratio (approx. 1.33:1.00) and to a high speed reduction ratio (approx. 1.0:1.0), and an ECU (electronic control unit) 34 arranged to electrically control the engine 31 and the transmission mechanism 33. The ECU 34 is an example of a "control portion" of a preferred embodiment of the present invention. An engine speed sensor 35 arranged to detect the engine speed of the engine 31 and an electronic throttle device 36 arranged to control the throttle opening of a throttle valve (not shown) of the engine 31 based on an accelerator opening signal described below are connected to the ECU 34. The engine speed sensor 35 is disposed in a vicinity of a crankshaft 301 (see FIG. 6) of the engine 31. The engine speed sensor 35 performs the functions of detecting the rotational speed of the crankshaft 301 and transmitting the detected rotational speed of the crankshaft 301 to the ECU 34. The rotational speed of the crankshaft 301 is an example of "engine speed" of a preferred embodiment of the present invention. The electronic throttle device 36 controls the throttle opening of the throttle valve (not shown) of the engine 31 based on the accelerator opening signal from the ECU 34 and also has a function to transmit the throttle opening to the ECU 34 and the control portion 52 described below.

In the present preferred embodiment, the ECU 34 has a function to generate an electromagnetic hydraulic pressure control valve driving signal based on a speed changing gear shift signal and a shift position signal sent by the control portion 52 of the control lever section 5 described below. An electromagnetic hydraulic pressure control valve 37 is connected to the ECU 34. The ECU 34 generates a control signal to send the electromagnetic hydraulic pressure control valve driving signal to the electromagnetic hydraulic pressure control valve 37. The electromagnetic hydraulic pressure control valve 37 is driven based on the electromagnetic hydraulic pressure control valve driving signal, and thereby the transmission mechanism 33 is controlled. Construction and operation of the transmission mechanism 33 will be described below in detail.

Figure 4:
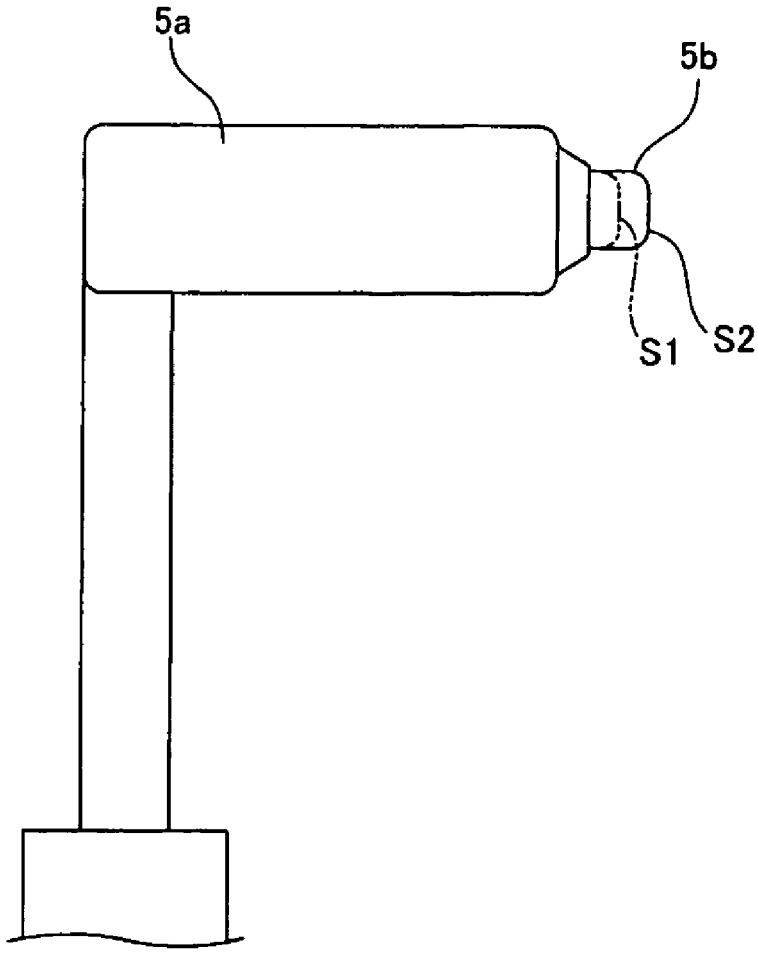
FIG. 4 is a front view showing a lever of the control lever section shown in FIG. 3.
Figure 5:
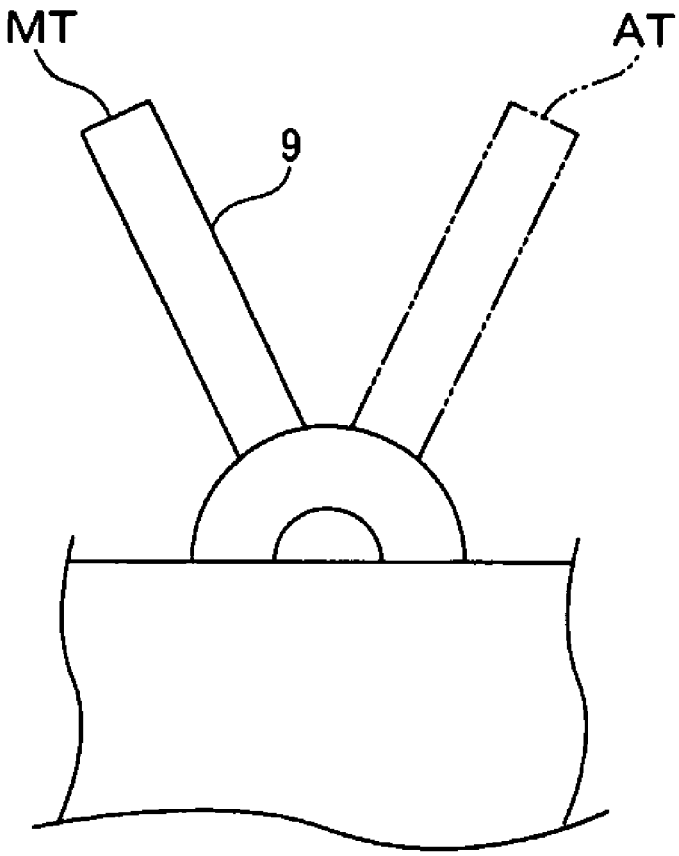
FIG. 5 is a side view showing a mode switching lever of the boat shown in FIG. 1.

In the present preferred embodiment, as shown in FIG. 4, the lever 5*a* of the control lever section 5 has a gear shift switch 5*b* with which the user selects the speed reduction ratio in the manual mode. The gear shift switch 5*b* can preferably be set to a shift-down position (depressed position) S1 corresponding to the low speed reduction ratio and a shift-up position (protruding position) S2 corresponding to the high speed reduction ratio by operation of the user. The gear shift switch 5*b* is an example of an "operation portion" of a preferred embodiment of the present invention. The control lever section 5 preferably includes a memory portion 51 in which a shift inhibition control map, a shift redirection control map, and a shift control map described below are stored; and the control portion 52 arranged to generate signals (speed changing gear shift signal, shift position signal, accelerator opening signal, mode signal) to be sent to the ECU 34. The control lever section 5 preferably further includes a shift position sensor 53 arranged to detect the shift position of the lever 5*a* and an accelerator position sensor 54 arranged to detect the opening of the lever (accelerator) opened or closed by operation on the lever 5*a*. The shift position sensor 53 is provided to detect which shift position the lever 5*a* is positioned among a neutral position, a position in front of the neutral position, and a position in the rear of the neutral position. The memory portion 51 and the control portion 52 are connected together. The control portion 52 is capable of reading out the shift control map and so forth stored in the memory portion 51. The control portion 52 is connected to both the shift position sensor 53 and the accelerator position sensor 54. Thereby, the control portion 52 can obtain a detection signal (shift position signal) detected by the shift position sensor 53 and the accelerator opening signal detected by the accelerator position sensor 54. The control portion 52 is connected to the gear shift switch 5*b* and the mode switching lever 9. The control portion 52 is connected to the gear shift switch 5*b*, and thereby can obtain a gear selection signal corresponding to a gear selected by the user in the manual mode. The control portion 52 is connected to the mode switching lever 9, and thereby can obtain a mode selection signal corresponding to the mode (manual mode or automatic mode) selected by the user.

The control portion 52 is preferably connected to both of the common LAN cables 7 and 8. Each of the common LAN cables 7 and 8 is connected to the ECU 34. The common LAN cables have functions to transmit a signal generated by the control portion 52 to the ECU 34 and to transmit a signal generated by the ECU 34 to the control portion 52. In other words, each of the common LAN cables 7 and 8 is capable of communication between the control portion 52 and the ECU 34. The common LAN cable 8 is provided electrically independently of the common LAN cable 7.

Specifically, the control portion 52 transmits the shift position signal of the lever 5*a* detected by the shift position sensor 53 to the display section 6 and the ECU 34 via the common LAN cable 7. The control portion 52 transmits the shift position signal not via the common LAN cable 8 but only via the common LAN cable 7. The control portion 52 transmits the mode selection signal obtained from the mode switching lever 9 to the display section 6 as the mode signal. The control portion 52 transmits the accelerator opening signal detected by the accelerator position sensor 54 to the ECU 34 not via the common LAN cable 7 but only via the common LAN cable 8.

The control portion 52 is capable of receiving an engine speed signal sent from the ECU 34 via the common LAN cable 8.

In the present preferred embodiment, the control portion 52 has a function to electrically control a shift between the reduction ratios of the transmission mechanism 33 based on operation of the control lever section 5 by a user in the automatic mode. Specifically, the control portion 52 has a function to generate the speed changing gear shift signal arranged to control the transmission mechanism 33 so that it shifts to the low speed or the high speed reduction ratio based on the shift control map provided by the accelerator opening and engine speed stored in the memory portion 51. The control portion 52 has a function to generate the speed changing gear shift signal arranged to control the transmission mechanism 33 so that it shifts to the low speed or the high speed reduction ratio based on the position of the gear shift switch 5*b* in the manual mode. The control portion 52 sends the generated speed changing gear shift signal to the display section 6 and the ECU 34 via the common LAN cables 7 and 8.

Figure 3:
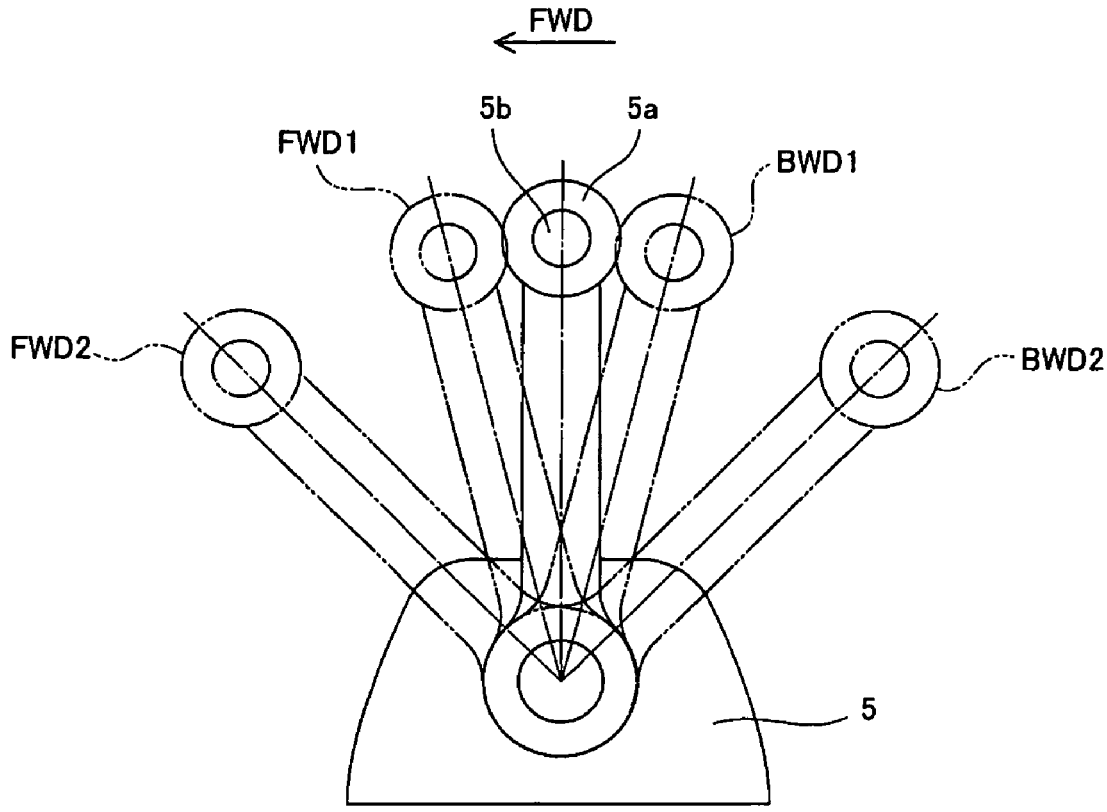
FIG. 3 is a side view illustrating an arrangement of a control lever section of the boat shown in FIG. 1.

The transmission mechanism 33 is controlled so that the hull 2 can travel forward when the lever 5*a* of the control lever section 5 is turned forward (direction of arrow FWD) (see FIG. 3). The transmission mechanism 33 is controlled so that it retains a neutral state in which the hull 2 is propelled neither forward nor rearward when the lever 5*a* is not turned in the fore-and-aft direction, as is the lever 5*a* shown in solid lines in FIG. 3. The transmission mechanism 33 is controlled so that the hull 2 can travel rearward when the lever 5*a* of the control lever section 5 is turned rearward (direction opposite to arrow FWD) (see FIG. 3).

The transmission mechanism 33 makes a shift-in operation (release from the neutral state) with the throttle valve (not shown) of the engine 31 fully closed (idling state) when the lever 5*a* of the control lever 5 is turned to position FWD1 in FIG. 3. The throttle valve (not shown) of the engine 31 fully opens when the lever 5*a* of the control lever section 5 is turned to position FWD2 in FIG. 3.

Similarly to the case that the lever 5*a* of the control lever section 5 is turned in the direction of arrow FWD, when the lever 5*a* is turned to position BWD1 in FIG. 3 in the direction opposite to the direction of arrow FWD, the transmission mechanism 33 makes a shift-in operation (release from the neutral state) with the throttle valve (not shown) of the engine 31 fully closed (idling state). The throttle valve (not shown) of the engine 31 fully opens when the lever 5*a* of the control lever 5 is turned to position BWD2 in FIG. 3.

The display section 6 preferably includes a speed display 61 indicating the traveling speed of the boat 1, a shift position display 62 indicating the shift position of the lever 5*a* of the control lever section 5, a gear display 63 indicating the gear in the engaged state in the transmission mechanism 33, and a mode display 64 indicating the mode manual mode (MT) or automatic mode (AT)) selected by the user. The traveling speed of the boat 1 displayed on the speed display 61 is calculated by the ECU 34 based on the engine speed sensor 35 and the intake state of the engine 31. Calculated data about the traveling speed of the boat 1 is transmitted to the display section 6 via the common LAN cables 7 and 8. The shift position displayed on the shift position display 62 is displayed based on the shift position signal sent from the control portion 52 of the control lever section 5. The gear in the engaged state in the transmission mechanism 33 displayed on the gear display 63 is displayed based on the speed changing gear shift signal sent from the control portion 52. The mode displayed on the mode display 64 is displayed based on the mode signal sent from the control portion 52. In other words, the display section 6 has a function to inform the user (operator of the boat) about the traveling state of the boat 1.

Figure 6:
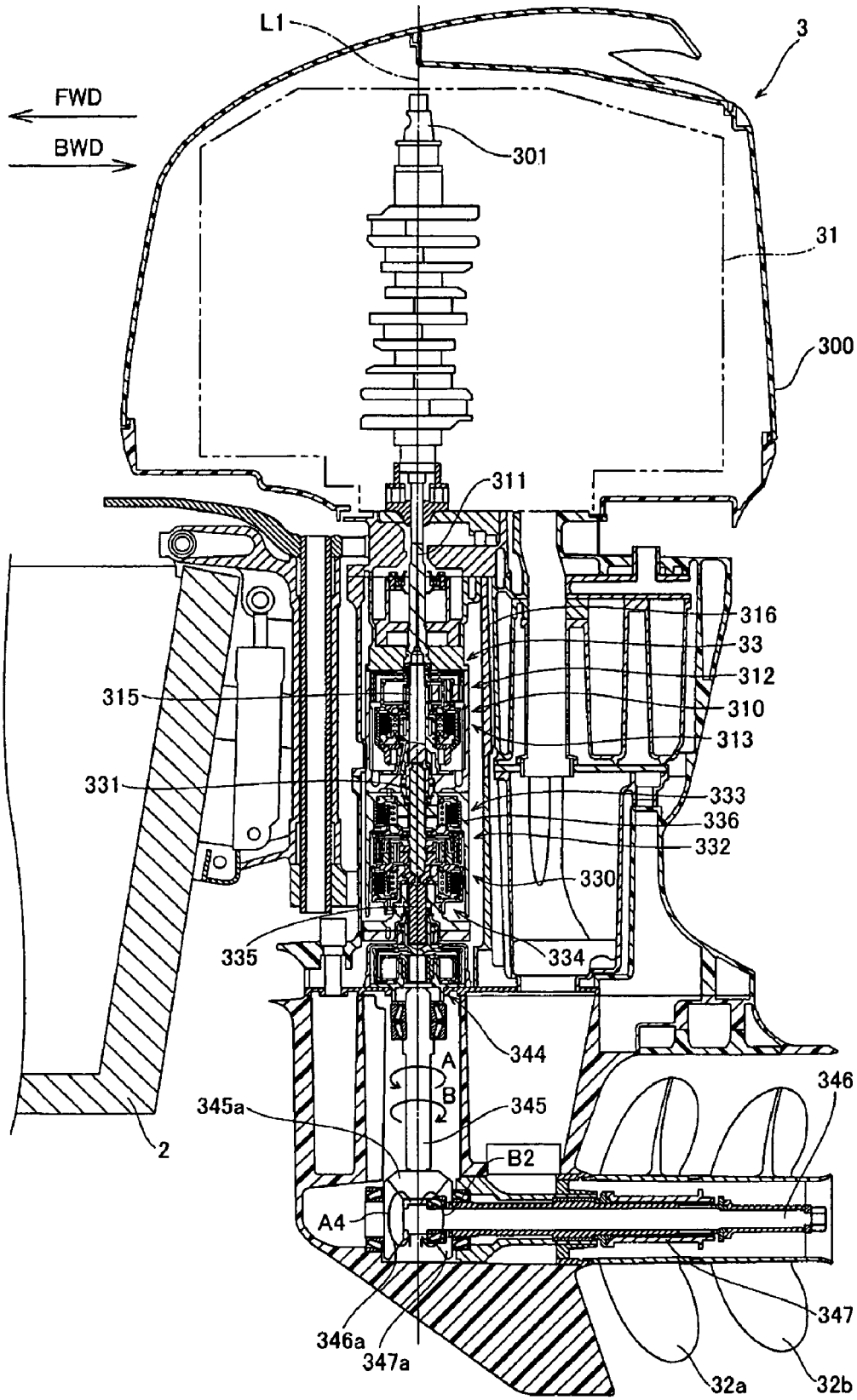
FIG. 6 is a cross-sectional view illustrating an arrangement of a marine propulsion system main body of the marine propulsion system shown in FIG. 1.

Next, construction of the engine 31 and the transmission mechanism 33 will be described. As shown in FIG. 6, the crankshaft 301 of the engine 31 rotates around axial line L1. The engine 31 generates a driving force through the rotation of the crankshaft 301. An upper portion of an upper transmission shaft 311 of the transmission mechanism 33 is connected to the crankshaft 301. The upper transmission shaft 311 is disposed along axial line L1 and rotates around axial line L1 together with the rotation of the crankshaft 301.

The transmission mechanism 33 includes the upper transmission shaft 311 described above to which the driving force of the engine 31 is input, an upper transmission section 310 capable of shifting so that the boat 1 can perform either high speed travel or low speed travel, and a lower transmission section 330 capable of shifting so that the boat 1 can perform either forward travel or reverse travel. In other words, the transmission mechanism 33 is arranged to be capable of transmitting the driving force generated by the engine 31 to the propellers 32*a* and 32*b* with the speed shifted to the low speed reduction ratio (approx. 1.33:1) and the high speed reduction ratio (approx. 1:1) in the forward travel and also capable of transmitting driving force to the propellers 32*a* and 32*b* with the speed shifted to the low speed reduction ratio and the high speed reduction ratio in the reverse travel.

Figure 7:
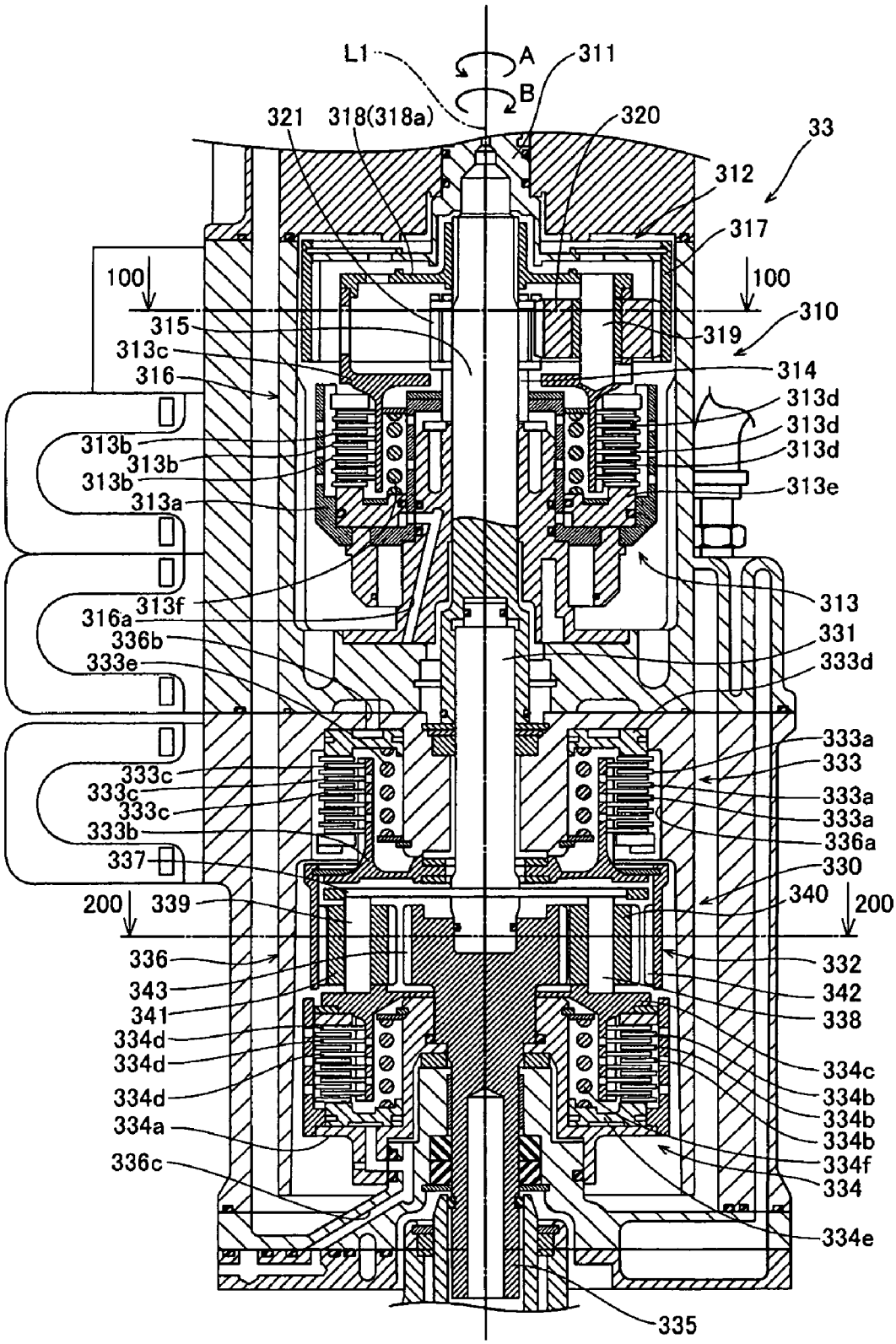
FIG. 7 is a cross-sectional view illustrating an arrangement of a transmission mechanism of the marine propulsion system main body of the marine propulsion system shown in FIG. 1.

As shown in FIG. 7, the upper transmission section 310 preferably includes the upper transmission shaft 311 described above, a planetary gear section 312 arranged to reduce the rotational speed of the driving force of the upper transmission shaft 311, a clutch 313 and a one-way clutch 314 arranged to control a rotation of the planetary gear section 312, an intermediate shaft 315 to which driving force of the upper transmission shaft 311 is transmitted via the planetary gear section 312, and an upper case section 316 defining a contour of the upper transmission section 310 with a plurality of members. The intermediate shaft 315 rotates at a rotational speed that is substantially not reduced when compared to the rotational speed of the upper transmission shaft 311 when the clutch 313 is in the engaged state. On the other hand, when the clutch 313 is in the disengaged state, the planetary gear section 312 rotates, and thus the intermediate shaft 315 rotates at a reduced rotational speed compared to the rotational speed of the upper transmission shaft 311.

Figure 8:
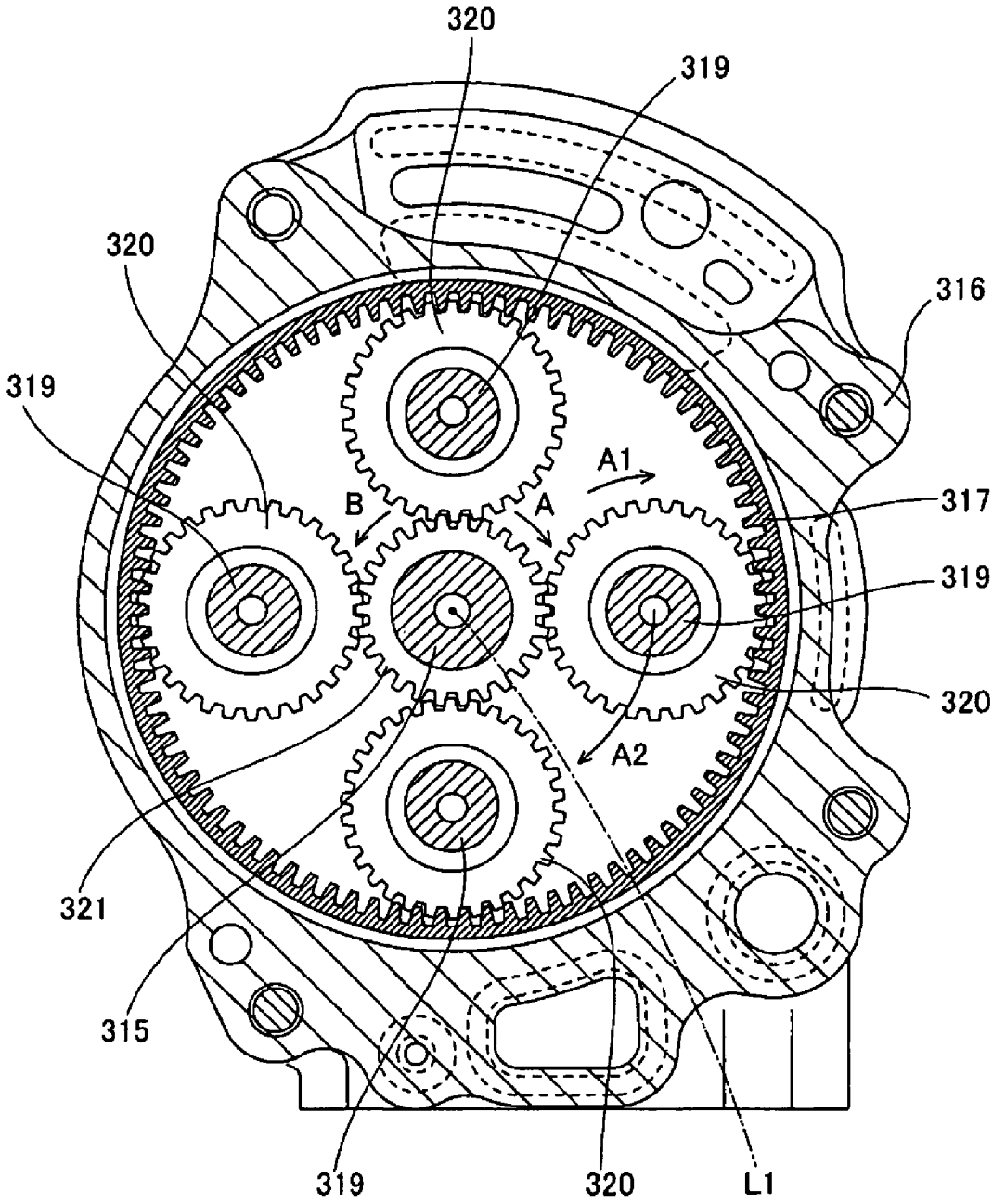
FIG. 8 is a cross-sectional view taken along line 100-100 of FIG. 7.

Specifically, a ring gear 317 is provided on a lower portion of the upper transmission shaft 311. A flange member 318 is fitted to an upper portion of the intermediate shaft 315 by spline-fitting. The flange member 318 is disposed inside the ring gear 317 (on a side opposing axial line L1). As shown in FIGS. 7 and 8, four shaft members 319 are fixed to a flange 318*a* of the flange member 318. Four planetary gears 320 are rotatably mounted on the respective four shaft members 319. Each of the planetary gears 320 is meshed with the ring gear 317. Each of the four planetary gears 320 is meshed with a sun gear 321 arranged to rotate around axial line L1. As shown in FIG. 7, the sun gear 321 is supported by the one-way clutch 314. The one-way clutch 314 is mounted on the upper case section 316 and can rotate only in direction A. Thereby, the sun gear 321 is arranged to rotate in only one direction (direction A).

The clutch 313 is preferably a wet type multi-plate clutch. The clutch 313 includes an outer case section 313*a* supported rotatably only in direction A by the one-way clutch 314, a plurality of clutch plates 313*b* disposed in an inner periphery of the outer case section 313*a* at certain intervals from each other, an inner case section 313*c* at least partially disposed inside the outer case 313*a*, and a plurality of clutch plates

313*d* mounted on the inner case section 313*c* and disposed in spaces between the plurality of clutch plates 313*b*. The clutch 313 enters the engaged state in which the outer case section 313*a* and the inner case section 313*c* rotate unitarily when the clutch plates 313*b* of the outer case section 313*a* and the clutch plates 313*d* of the inner case section 313*c* contact with each other. Meanwhile, the clutch 313 enters the disengaged state in which the outer case section 313*a* and the inner case section 313*c* do not unitarily rotate when the clutch plates 313*b* of the outer case section 313*a* and the clutch plates 313*d* of the inner case section 313*c* are separated from each other.

Specifically, a piston 313*e* slidable on an inner peripheral surface of the outer case section 313*a* is disposed in the outer case section 313*a*. The piston 313*e* moves the plurality of the clutch plates 313*b* of the outer case section 313*a* in a direction in which the piston 313*e* slides on the inner peripheral surface of the outer case section 313*a*. A compression coil spring 313*f* is disposed in the outer case section 313*a*. The compression coil spring 313*f* is disposed to urge the piston 313*e* in a direction in which the clutch plates 313*b* of the outer case section 313*a* are separated from the clutch plates 313*d* of the inner case section 313*c*. The piston 313*e* slides on the inner peripheral surface of the outer case section 313*a* against a reaction of the compression coil spring 313*f* when the electromagnetic hydraulic pressure control valve 37 described above increases pressure of the oil flowing through an oil passage 316*a* of the upper case section 316. Accordingly, the pressure of the oil flowing through the oil passage 316*a* of the upper case section 316 is increased or reduced, thereby allowing contact and separation between the clutch plates 313*b* of the outer case section 313*a* and the clutch plates 313*d* of the inner case section 313*c*. Therefore, the clutch 313 can be engaged or disengaged.

Lower ends of the four shaft members 319 are mounted on an upper portion of the inner case section 313*c*. In other words, the inner case section 313*c* is connected to the flange member 318 on which each of upper portions of the four shaft members 319 are mounted via the four shaft members 319. Thereby, the inner case section 313*c*, the flange member 318, and the shaft members 319 can simultaneously rotate around axial line L1.

The planetary gear section 312 and the clutch 313 are constructed as described above. Therefore, when the clutch 313 is disengaged, the ring gear 317 rotates in direction A together with the upper transmission shaft 311 rotating in direction A. In this case, the sun gear 321 does not rotate in direction B opposite to direction A. Therefore, as shown in FIG. 8, each of the planetary gears 320 rotates around the shaft member 319 in direction A1 and at the same time revolves around axial line L1 in direction A2 together with the shaft member 319. Thereby, the flange member 318 (see FIG. 7) rotates around axial line L1 in direction A while the shaft members 319 revolve in direction A2. As a result, the intermediate shaft 315 fitted to the flange member 318 by spline-fitting, for example, can be rotated around axial line L1 in direction A at the reduced rotational speed when compared to the rotational speed of the upper transmission shaft 311.

The planetary gear section 312 and the clutch 313 are constructed as described above. Accordingly, when the clutch 313 is engaged, the ring gear 317 rotates in direction A together with the upper transmission shaft 311 rotating in direction A. In this case, the sun gear 321 does not rotate in direction B opposite to direction A. Therefore, each of the planetary gears 320 rotates around the shaft member 319 in direction A1 and at the same time revolves around axial line L1 in direction A2 together with the shaft member 319. At this point, since the clutch 313 is engaged, the outer case section 313*a* (see FIG. 7) of the clutch 313 rotates in direction A together with the one-way clutch 314 (see FIG. 7). Thereby, the sun gear 321 rotates around axial line L1 in direction A. Therefore, the planetary gears 320 substantially do not rotate around the shaft members 319, but the shaft members 319 revolve around axial line L1 in direction A. Accordingly, the flange member 318 rotates at a speed generally equivalent to the rotational speed of the upper transmission shaft 311 since the speed is not substantially reduced by the planetary gears 320. As a result, the intermediate shaft 315 can be rotated around axial line L1 in direction A at the speed generally equivalent to the rotational speed of the upper transmission shaft 311.

As shown in FIG. 7, the lower transmission section 330 is provided below the upper transmission section 310. The lower transmission section 330 includes an intermediate transmission shaft 331 connected to the intermediate shaft 315, a planetary gear section 332 arranged to reduce the rotational speed of the driving force of the intermediate transmission shaft 331, forward-reverse switching clutches 333 and 334 arranged to control rotation of the planetary gear section 332, a lower transmission shaft 335 to which the driving force of the intermediate transmission shaft 331 is transmitted via the planetary gear section 332, and a lower case section 336 defining a contour of the lower transmission section 330. Further, the lower transmission section 330 is arranged such that the lower transmission shaft 335 rotates in a direction (direction B) opposite to the rotational direction (direction A) of the intermediate shaft 315 (the upper transmission shaft 311) when the forward-reverse switching clutch 333 is engaged and the forward-reverse switching clutch 334 is disengaged. In this case, the lower transmission section 330 does not rotate propeller 32*b* but rotates only the propeller 32*a* so that the boat 1 can travel rearward. On the other hand, the lower transmission section 330 is constructed such that the lower transmission shaft 335 rotates in the same direction as the rotational direction (direction A) of the intermediate shaft 315 (the upper transmission shaft 311) when the forward-reverse switching clutch 333 is disengaged and the forward-reverse switching clutch 334 is engaged. In this case, the lower transmission section 330 rotates the propeller 32*a* in a direction opposite to the case of the reverse travel of the boat 1 and rotates the propeller 32*b* in a direction opposite to the rotational direction of the propeller 32*a* so that the boat 1 can travel forward. The lower transmission section 330 is constructed so that the forward-reverse switching clutches 333 and 334 are both not engaged at the same time. The lower transmission section 330 is constructed so that rotation of the intermediate shaft 315 (the upper transmission shaft 311) is not transmitted to the lower transmission shaft 335 (the lower transmission section 330 becomes the neutral state) when both the forward-reverse switching clutches 333 and 334 are in the disengaged state.

Figure 9:
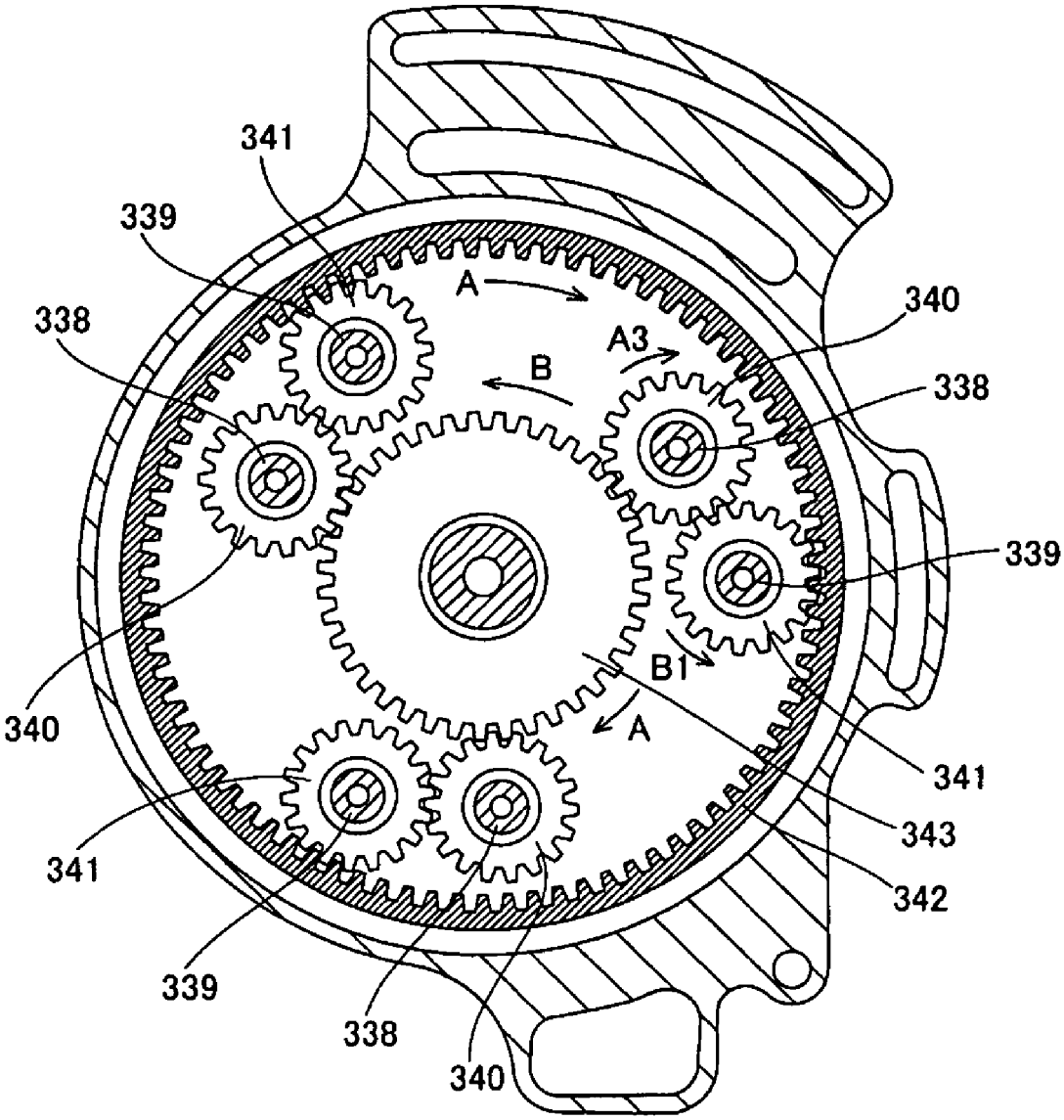
FIG. 9 is a cross-sectional view taken along line 200-200 of FIG. 7.

Specifically, the intermediate transmission shaft 331 rotates together with the intermediate shaft 315. A flange 337 is provided on a lower portion of the intermediate transmission shaft 331. As shown in FIGS. 7 and 9, three inner shaft members 338 and three outer shaft members 339 are fixed to the flange 337. Three inner planetary gears 340 are rotatably mounted on the respective three inner shaft members 338. Each of the inner planetary gears 340 is meshed with the sun gear 343 described below. Three outer planetary gears 341 are rotatably mounted on the respective three outer shaft members 339. Each of the three outer planetary gears 341 are meshed with the inner planetary gear 340 and with a ring gear 342 described later.

The forward-reverse switching clutch 333 is provided in an upper portion of the lower case section 336. The forward-reverse switching clutch 333 is preferably a wet type multi-plate clutch. A portion thereof is provided with a recess 336*a* of the lower case section 336. The forward-reverse switching clutch 333 includes a plurality of clutch plates 333*a* disposed in an inner periphery of the recess 336*a* at certain intervals from each other, an inner case section 333*b* at least partially disposed inside the recess 336*a*, and a plurality of clutch plates 333*c* mounted on the inner case section 333*b* and disposed in spaces between the plurality of clutch plates 333*a*. The forward-reverse switching clutch 333 is constructed such that the lower case section 336 restrains rotation of the inner case section 333*b* when the clutch plates 333*a* of the recess 336*a* and the clutch plates 333*c* of the inner case section 333*b* contact with each other. Meanwhile, the forward-reverse switching clutch 333 is constructed such that the inner case section 333*b* freely rotates with respect to the lower case section 336 when the clutch plates 333*a* of the recess 336*a* and the clutch plates 333*c* of the inner case section 333*b* are separated from each other.

Specifically, a piston 333*d* slidable on an inner peripheral surface of the recess 336*a* is disposed in the recess 336*a* of the lower case section 336. The piston 333*d* moves the clutch plates 333*a* of the recess 336*a* in a direction in which the piston 333*d* slides on the inner peripheral surface of the recess 336*a*. A compression coil spring 333*e* is disposed in the recess 336*a* of the lower case section 336. The compression coil spring 333*e* is disposed to urge the piston 333*d* in a direction in which the clutch plates 333*a* of the recess 336*a* are separated from the clutch plates 333*c* of the inner case section 333*b*. The piston 333*d* slides on the inner peripheral surface of the recess 336*a* against reaction of the compression coil spring 333*e* when the electromagnetic hydraulic pressure control valve 37 described above increases the pressure of oil flowing through an oil passage 336*b* of the lower case section 336. Accordingly, the pressure of the oil flowing through the oil passage 336*b* of the lower case section 336 is increased or reduced, thereby allowing engagement and disengagement of the forward-reverse switching clutch 333.

A ring-shaped ring gear 342 is mounted in the inner case section 333*b* of the forward-reverse switching clutch 333. As shown in FIGS. 7 and 9, the ring gear 342 is meshed with the three outer planetary gears 341.

As shown in FIG. 7, the forward-reverse switching clutch 334 is provided in a lower portion of the lower case section 336 and is preferably a wet type multi-plate clutch. The forward-reverse switching clutch 334 mainly includes an outer case section 334*a*, a plurality of clutch plates 334*b* disposed in an inner periphery of the outer case section 334*a* at certain intervals from each other, an inner case section 334*c* at least partially disposed inside the outer case 334*a*, and a plurality of clutch plates 334*d* mounted on the inner case section 334*c* and disposed in spaces between the plurality of clutch plates 334*b*. The forward-reverse switching clutch 334 is constructed such that the inner case section 334*c* and the outer case section 334*a* unitarily rotate around axial line L1 when the clutch plates 334*b* of the outer case section 334*a* and the clutch plates 334*d* of the inner case section 334*c* contact with each other. On the other hand, the forward-reverse switching clutch 334 is constructed such that the inner case section 334*c* freely rotates with respect to the outer case section 334*a* when the clutch plates 334*b* of the outer case section 334*a* and the clutch plates 334*d* of the inner case section 334*c* are separated from each other.

Specifically, a piston 334*e* slidable on an inner peripheral surface of the outer case section 334*a* is disposed in the outer case section 334*a*. The piston 334*e* moves the plurality of the clutch plates 334*b* of the outer case section 334*a* in a direction in which the piston 334*e* slides when it slides on the inner peripheral surface of the outer case section 334*a*. A compression coil spring 334*f* is disposed in the outer case section 334*a*. The compression coil spring 334*f* is disposed to urge the piston 334*e* in a direction in which the clutch plates 334*b* of the outer case section 334*a* are separated from the clutch plates 334*d* of the inner case section 334*c*. The piston 334*e* slides on the inner peripheral surface of the outer case section 334*a* against reaction of the compression coil spring 334*f* when the electromagnetic hydraulic pressure control valve 37 described above increases the pressure of the oil flowing through an oil passage 336*c* of the lower case section 336. Accordingly, the pressure of the oil flowing through the oil passage 336*c* of the lower case section 336 is increased or reduced, thereby allowing engagement and disengagement of the forward-reverse switching clutch 334.

The three inner shaft members 338 and the three outer shaft members 339 are fixed to the inner case section 334*c* of the forward-reverse switching clutch 334. In other words, the inner case section 334*c* is connected to the flange 337 by the three inner shaft members 338 and the three outer shaft members 339 and rotates around axial line L1 together with the flange 337. The outer case section 334*a* of the forward-reverse switching clutch 334 is mounted on the lower transmission shaft 335 and rotates around axial line L1 together with the lower transmission shaft 335.

The sun gear 343 is unitarily formed with an upper portion of the lower transmission shaft 335. As shown in FIG. 9, the sun gear 343 is meshed with the inner planetary gears 340 as described above. The inner planetary gears 340 are meshed with the outer planetary gears 341 meshed with the ring gear 342. The sun gear 343 rotates around axial line L1 in direction B via the inner planetary gears 340 and the outer planetary gears 341 when the flange 337 rotates in direction A together with the intermediate transmission shaft 331 rotating around axial line L1 in direction A when the ring gear 342 does not rotate due to engagement of the forward-reverse switching clutch 333.

The planetary gear section 332, the forward-reverse switching clutches 333 and 334 are constructed as described above. Thereby, when the forward-reverse switching clutch 333 is engaged, the ring gear 342 mounted on the inner case section 333*b* is fixed to the lower case section 336. At this point, the forward-reverse switching clutch 334 is disengaged as described above. Therefore, the outer case section 334*a* and the inner case section 334*c* of the forward-reverse switching clutch 334 can separately rotate. In this case, when the flange 337 rotates around axial line L1 in direction A together with the intermediate transmission shaft 331 rotating around axial line L1 in direction A, each of the three inner shaft members 338 and the three outer shaft members 339 revolves around axial line L1 in direction A. The outer planetary gears 341 mounted on the outer shaft members 339 rotate around the outer shaft members 339 in direction B1. The inner planetary gears 340 rotate around the inner shaft members 338 in direction A3 together with rotation of the outer planetary gears 341. Accordingly, the sun gear 343 rotates around axial line L1 in direction B. As a result, as shown in FIG. 7, the lower transmission shaft 335 rotates around axial line L1 in direction B together with the outer case section 334*a* although the inner case section 334*c* rotates around axial line L1 in direction A. Accordingly, the lower transmission shaft 335 can be rotated in the direction (direction B) opposite to the rotational direction (direction A) of the intermediate shaft 315 (the upper transmission shaft 311) when the forward-reverse switching clutch 333 is in the engaged state and the forward-reverse switching clutch 334 is in the disengaged state. The planetary gear section 332 and the forward-reverse switching clutches 333 and 334 are constructed as described above. Thereby, when the forward-reverse switching clutch 333 is disengaged, the ring gear 342 mounted on the inner case section 333*b* can freely rotate with respect to the lower case section 336. In this case, the forward-reverse switching clutch 334 can become either the engaged state or the disengaged state.

Next, descriptions will be made about a case when the forward-reverse switching clutch 334 is engaged. When the flange 337 rotates in direction A together with the intermediate transmission shaft 331 rotating around axial line L1 in direction A, each of the three inner shaft members 338 and the three outer shaft members 339 revolves around axial line L1 in direction A as shown in FIG. 9. In this case, the ring gear 342 meshed with the outer planetary gears 341 freely rotate. Therefore, the inner planetary gears 340 and the outer planetary gears 341 are idle. In other words, the driving force of the intermediate transmission shaft 331 is not transmitted to the sun gear 343. Meanwhile, since the forward-reverse switching clutch 334 is engaged, as shown in FIG. 7, the outer case section 334*a* rotates around axial line L1 in direction A together with rotation around axial line L1 in direction A of the inner case section 334*c* which can rotate around axial line L1 in direction A together with the three inner shaft members 338 and the three outer shaft members 339. Accordingly, the lower transmission shaft 335 rotates around axial line L1 in direction A together with the outer case section 334*a*. As a result, the lower transmission shaft 335 can be rotated in the same direction as the rotational direction (direction A) of the intermediate shaft 315 (the upper transmission shaft 311) when the forward-reverse switching clutch 333 is in the disengaged state and the forward-reverse switching clutch 334 is in the engaged state.

As shown in FIG. 6, a speed reducing device 344 is provided below the transmission mechanism 33. The lower transmission shaft 335 of the transmission mechanism 33 is input to the speed reducing device 344. The speed reducing device 344 has a function to reduce the rotational speed of a driving force input by the lower transmission shaft 335. A drive shaft 345 is provided below the speed reducing device 344. The drive shaft 345 rotates in the same direction as the lower transmission shaft 335. A bevel gear 345*a* is provided in a lower portion of the drive shaft 345.

A bevel gear 346*a* of an inner output shaft 346 and a bevel gear 347*a* of an outer output shaft 347 are meshed with the bevel gear 345*a* of the drive shaft 345. The inner output shaft 346 is arranged to extend rearward (direction of arrow BWD). The propeller 32*b* described above is mounted on a portion of the inner output shaft 346 in the direction of arrow BWD. The outer output shaft 347 is arranged to extend in the direction of arrow BWD similarly to the inner output shaft 346. The propeller 32*a* described above is mounted on a portion of the outer output shaft 347 in the direction of arrow BWD. The outer output shaft 347 is hollow. The inner output shaft 346 is inserted in a cavity of the outer output shaft 347. The inner output shaft 346 and the outer output shaft 347 can rotate independently of each other.

The bevel gear 346*a* is meshed with a side of the bevel gear 345*a* in the direction of arrow FWD. The bevel gear 347*a* is meshed with a side of the bevel gear 345*a* in the direction of arrow BWD. Thereby, when the bevel gear 346*a* rotates, the inner output shaft 346 and the outer output shaft 347 rotate in directions opposite to each other.

Specifically, the bevel gear 346*a* rotates in direction A4 when the drive shaft 345 rotates in direction A. The propeller 32*b* rotates in direction A4 via the inner output shaft 346 together with rotation of the bevel gear 346*a* in direction A4. Further, when the drive shaft 345 rotates in direction A, the bevel gear 347*a* rotates in direction B2. The propeller 32*a* rotates in direction B2 via the outer output shaft 347 together with rotation of the bevel gear 347*a* in direction B2. The propeller 32*a* rotates in direction B2 and the propeller 32*b* rotates in direction A4 (direction opposite to direction B2). Thereby, the boat 1 travels in the direction of arrow FWD (forward travel direction).

Further, when the drive shaft 345 rotates in direction B, the bevel gear 346*a* rotates in direction B2. The propeller 32*b* rotates in direction B2 via the inner output shaft 346 together with rotation of the bevel gear 346*a* in direction B2. The bevel gear 347*a* rotates in direction A4 when the drive shaft 345 rotates in direction B. In this case, the outer output shaft 347 does not rotate in direction A4. The propeller 32*a* rotates in neither direction A4 nor direction B2. In other words, only the propeller 32*b* rotates in direction A4. The propeller 32*b* rotates in direction B2, and thereby the boat 1 travels in the direction of arrow BWD (reverse travel direction).

Figure 10:
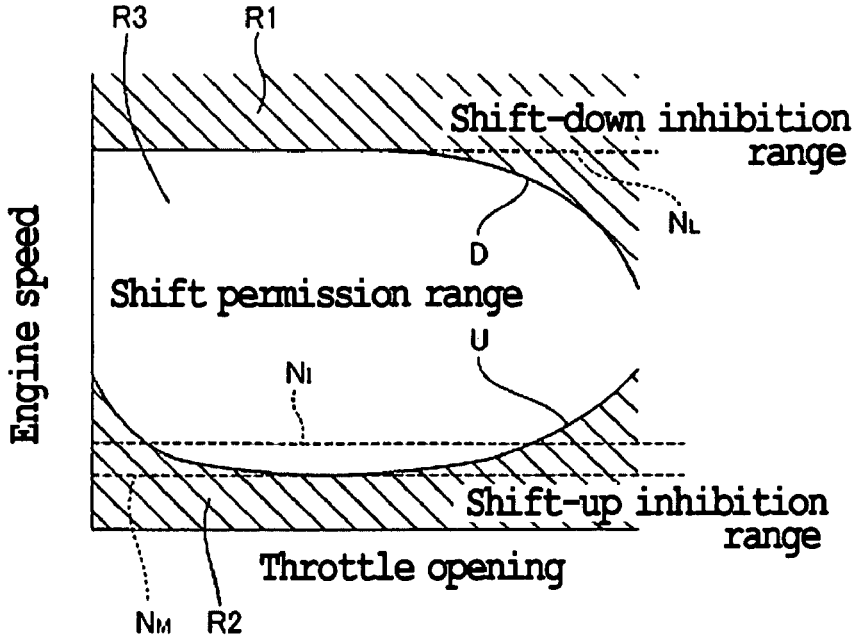
FIG. 10 is a diagram illustrating a shift inhibition control map for a manual mode of the marine propulsion system shown in FIG. 1.
Figure 11:
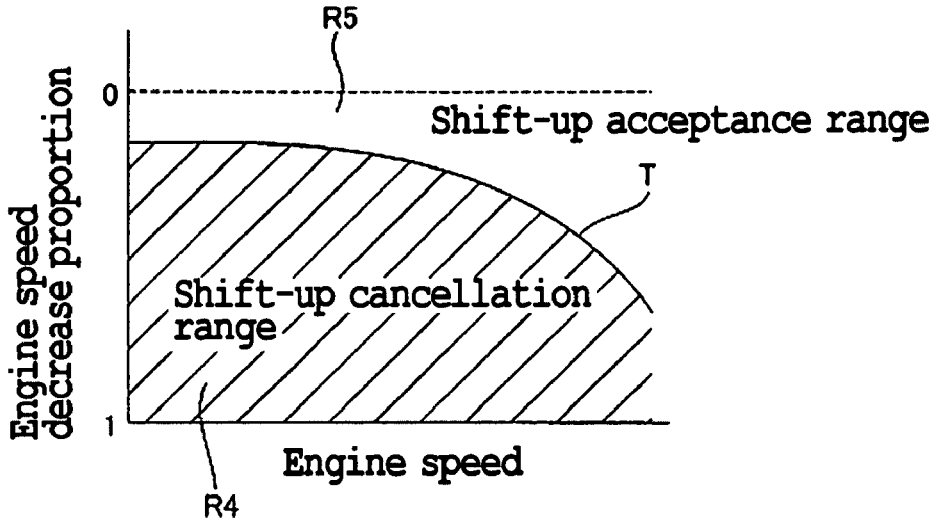
FIG. 11 is a diagram illustrating a shift redirection control map for the manual mode of the marine propulsion system shown in FIG. 1.

FIG. 10 is a diagram illustrating the shift inhibition control map for the manual mode of the marine propulsion system in accordance with a preferred embodiment of the present invention. FIG. 11 is a diagram illustrating the shift redirection control map for the manual mode of the marine propulsion system in accordance with a preferred embodiment of the present invention. Next, the shift control in the manual mode will be described in detail with reference to FIGS. 4, 10, and 11.

In the manual mode, the user operates the gear shift switch 5*b*, and thereby can arbitrarily shift gears. However, a shift in response to an operation of the user may cause an adverse effect on the engine depending on a state of the engine at the time of the shift. Therefore, in the present preferred embodiment, a shift is not executed even though the user operates the gear shift switch 5*b* in particular engine states. Specifically, the control portion 52 does not execute a shift-down operation when the engine speed is larger than a certain threshold value, and the control portion 52 does not execute a shift-up operation when the engine speed is smaller than a certain threshold value. In the present preferred embodiment, the shift inhibition control map is used as described above. The shift inhibition control map is an example of a "first shift control map" of a preferred embodiment of the present invention.

As shown in FIG. 10, the shift inhibition control map in accordance with the present preferred embodiment is defined by the relationship between the engine speed of the engine 31 and the throttle opening. The vertical axis represents the engine speed and the horizontal axis represents the throttle opening on the shift inhibition control map. The shift inhibition control map includes a shift-down inhibition range R1 in which the shift from the high speed to the low speed is inhibited, a shift-up inhibition range R2 in which the shift from the low speed to the high speed is inhibited, and a shift execution range R3 provided between the shift-down inhibition range R1 and the shift-up inhibition range R2 in which a shift is executed as instructed by the user (operation on the gear shift switch 5*b*). The shift-down inhibition range R1 is provided in a zone for large engine speeds. The shift-up inhibition range is provided in a zone for small engine speed. The shift-down inhibition range R1, the shift-up inhibition range R2, and the shift execution range R3 are defined by a shift-down inhibition referential curve D and a shift-up inhibition referential curve U. The shift-down inhibition referential curve D is a curve which passes through a limit engine speed $N_L$ in a range that the throttle opening is equal to or less than a certain value, and also a curve on which the engine speed becomes smaller as the throttle opening becomes larger in a range that the throttle opening is equal to or larger than a certain value. The limit engine speed $N_L$ is a speed that the engine speed of the engine 31 may exceed an allowable engine speed of the engine 31. The shift-up inhibition referential curve U is a curve that the engine speed gradually becomes smaller as the throttle opening becomes larger in a range that the throttle opening is relatively small. Specifically, the shift-up inhibition referential curve U is set such that the engine speed gradually becomes smaller from a value larger than an idling engine speed $N_I$ to a value smaller than the idling engine speed $N_I$ as the throttle opening becomes larger, and reaches a minimum value $N_M$. The shift-up inhibition referential curve U is a curve in which the engine speed gradually becomes larger as the throttle opening becomes larger in a range that the throttle opening is relatively large. Specifically, the shift-up inhibition referential curve U is set such that the engine speed gradually increases and becomes larger than the idling engine speed $N_I$ as the throttle opening becomes larger after the engine speed reaches the minimum value $N_M$. The threshold values for determinations on permissions for shift-up and shift-down operation are determined by the control portion 52 based on the shift-down inhibition referential line D, the shift-up inhibition referential line U, and the throttle opening. A shift control map for shift-down operation in accordance with the present preferred embodiment is used in common for both the forward travel and the reverse travel.

In the present preferred embodiment, the control portion 52 and the ECU 34 do not execute a shift when the engine speed and the throttle opening of the boat 1 is in the shift-down inhibition range R1 or the shift-up inhibition range R2 on the shift inhibition control map. In other words, when the user depresses the gear shift switch 5*b* and the gear shift switch 5*b* is positioned in the shift-down position S1 (see FIG. 4), the shift-down operation is not executed if the engine speed and the throttle opening is in the shift-down inhibition range R1 at a point that the user makes an instruction to shift. When the user makes the gear shift switch 5*b* protrude to a position higher than the shift-down position S1 and the gear shift switch 5*b* is positioned in the shift-up position S2 (see FIG. 4), the shift-up operation is not executed if the engine speed and the throttle opening is in the shift-up inhibition range R2 at a point that the user makes an instruction to shift. When a shift is not executed in such a manner, a shift is executed after the engine speed and the throttle opening enter the shift execution range R3.

In the present preferred embodiment, the shift-down operation is made when the shift-up operation is made in the manual mode and the engine speed largely decreases after the shift-up operation compared to the engine speed before the shift-up operation. In the present preferred embodiment, the shift redirection control map is used to perform the controls described above. The shift redirection control map is an example of a "second shift control map" of a preferred embodiment of the present invention.

As shown in FIG. 11, the shift redirection control map in accordance with the present preferred embodiment is provided by the relationship between the engine speed of the engine 31 and the decrease proportion of the engine speed after the shift-up operation to the engine speed before the shift-up operation. The vertical axis represents the decrease proportion of the engine speed and the horizontal axis represents the engine speed before the shift-up operation on the shift redirection control map. The shift redirection control map includes a shift-up cancellation range R4 in which the shift-down operation is again made after the shift-up operation is made once and shift-up acceptance range R5 in which no shift-down operation is made after the shift-up operation. The boundary curve T between the shift-up cancellation range R4 and the shift-up acceptance range R5 is a curve that the decrease proportion of the engine speed becomes larger as the engine speed becomes larger. A threshold (a decrease proportion of an engine speed) for a determination about whether the shift-down operation is again made or not is determined by the control portion 52 based on the boundary curve T and the engine speed. The shift redirection control map in accordance with the present preferred embodiment is commonly used for both the forward travel and the rearward travel.

Figure 12:
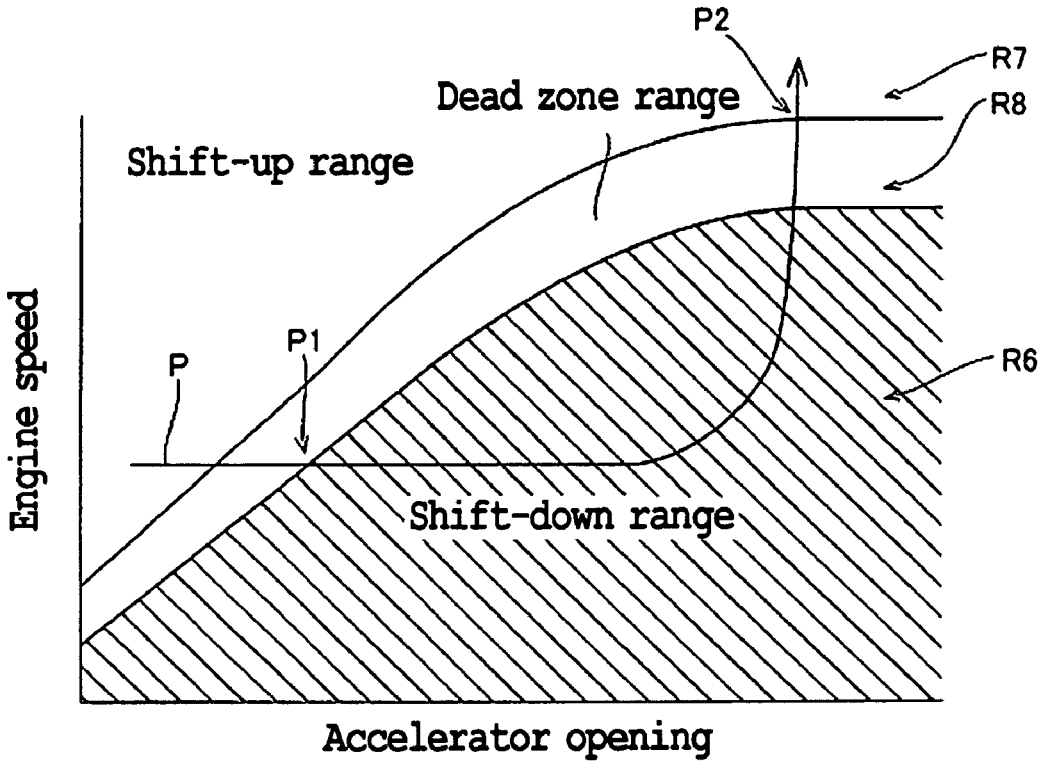
FIG. 12 is a diagram illustrating a shift control map for an automatic mode of the marine propulsion system shown in FIG. 1.

FIG. 12 is a map illustrating the shift control map for the automatic mode of the marine propulsion system in accordance with a preferred embodiment of the present invention. Next, descriptions will be made in detail about the shift control map for the automatic mode and shift control with use of the map with reference to FIG. 12.

The gear shift switch 5*b* is ineffective in the automatic mode. A shift is automatically made in response to operation (accelerator operation) on the lever 5*a* by the user. The control portion 52 determines a timing to execute a shift based on the shift control map shown in FIG. 12.

As shown in FIG. 12, the shift control map for the automatic mode is provided by the relationship between the engine speed of the engine 31 and the accelerator opening. The vertical axis represents the engine speed and the horizontal axis represents the accelerator opening on the shift control map. The shift control map includes a shift-down range R6 providing the low speed reduction ratio, a shift-up range R7 providing the high speed reduction ratio, and a dead zone range R8 provided at a boundary between the shift-down range R6 and the shift-up range R7. The shift control map in accordance with the present preferred embodiment is used in common for the forward travel and the rearward travel.

In the automatic mode, when a locus P on the shift control map given by the engine speed and the accelerator opening of the boat 1 enters the shift-down range R6 from the shift-up range R7 via the dead zone range R8 (locus P1 indicated in FIG. 12), the control portion 52 and the ECU 34 controls the transmission mechanism 33 to make shift-down operation (shift from the high speed reduction ratio to the low speed reduction ratio). When a locus P given by the engine speed and the accelerator opening enters the shift-up range R7 from the shift-down range R6 via the dead zone range R8 (locus P2 indicated in FIG. 12), the control portion 52 and the ECU 34 controls the transmission mechanism 33 to make a shift-up operation (shift from the low speed reduction ratio to the high speed reduction ratio). The dead zone range R8 is provided to prevent frequent shifts between the reduction ratios. A shift is not made when a locus just enters the dead zone range R8 from the shift-up range R7 or just enters the dead zone range R8 from the shift-down range R6.

Figure 13:
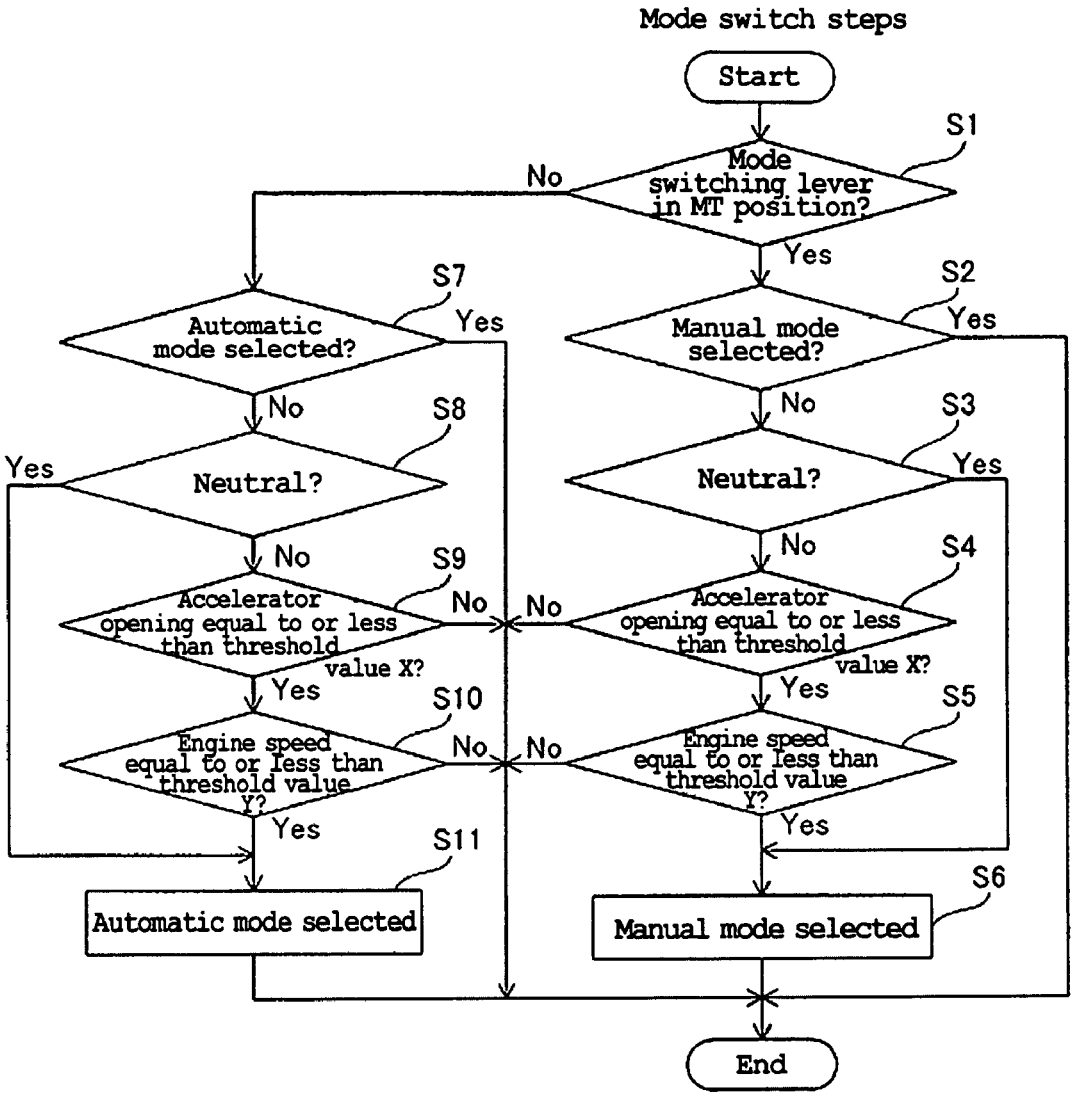
FIG. 13 is a flowchart for demonstrating mode switch steps of the marine propulsion system shown in FIG. 1.

In the present preferred embodiment, the user operates the mode switching lever 9, and thereby can switch between the manual mode and the automatic mode. Since the boat 1 may suddenly accelerate or decelerate when a switch between the modes is made when the engine load is large, a switch between the modes is not executed when the engine load is large. FIG. 13 is a flowchart demonstrating mode switch steps of the marine propulsion system in accordance with a preferred embodiment of the present invention. Next, the mode switch steps of the marine propulsion system will be described with reference to FIG. 13. A series of steps demonstrated in the flowchart are made approximately every 100 milliseconds, for example. Either the manual mode or the automatic mode is always selected.

The user operates the mode switching lever 9 to switch the modes. In a case of selecting the manual mode, the mode switching lever 9 is positioned in the MT position corresponding to the manual mode. In a case of selecting the automatic mode, the mode switching lever 9 is positioned in the AT position corresponding to the automatic mode. Thereby, the mode selection signal corresponding to the manual mode or the automatic mode is sent from the mode switching lever 9 to the control portion 52. At this point, the control portion 52 determines whether the mode switching lever 9 is positioned in the MT position or not in step S1 in FIG. 13. Specifically, the control portion 52 determines the position of the mode switching lever 9 based on the mode selection signal received from the mode switching lever 9.

When the mode switching lever 9 is positioned in the MT position, the control portion 52 determines whether the manual mode is selected or not in step S2. If the manual mode is selected, the mode switch steps end without executing a switch between the modes.

If the manual mode is not selected (the automatic mode is selected), it is a case when the automatic mode is selected in the control portion 52 although the mode switching lever 9 is positioned in the MT position. Therefore, a switch from the automatic mode to the manual mode is executed. Now, in step S3, the control portion 52 determines whether the position of the lever 5*a* is the neutral position or not. If the lever 5*a* is in the neutral position, the accelerator opening (the opening of the lever 5*a*) is zero, and the engine speed is an idling speed. Therefore, the engine load is not large, and thus the manual mode is selected in step S6. Accordingly, the mode switch steps end.

If the lever 5*a* is not in the neutral position, the lever 5*a* is turned forward or rearward, and the accelerator is opened (the engine load is larger than that of the idling time). The control portion 52 determines whether a switch between the modes is made or not based on the magnitude of the engine load. In other words, in step S4, the control portion 52 determines whether the accelerator opening (the opening of the lever 5*a*) is equal to or less than a certain threshold value X or not. If the accelerator opening (the opening of the lever 5*a*) is equal to or less than the threshold value X, the control portion 52 determines whether the engine speed is equal to or less than a certain threshold value Y or not in step S5. If the accelerator opening is equal to or less than the threshold value X and the engine speed is equal to or less than the threshold value Y, the control portion 52 determines that the engine load is not large and selects the manual mode in step S6. The mode switch steps end.

If the accelerator opening is larger than the threshold value X or the engine speed is larger than the threshold value Y, the control portion 52 determines that the engine load is large. The mode switch steps end without executing a switch between the modes.

If the mode switching lever 9 is in the AT position corresponding to the automatic mode in step S1, the control portion 52 determines whether the automatic mode is selected or not in step S7. If the automatic mode is selected, the mode switch steps end without executing a switch between the modes. If the manual mode is selected, it is a state that the automatic mode is not selected in the control portion 52 although the mode switching lever 9 is positioned in the AT position corresponding to the automatic mode. Therefore, the control portion 52 determines whether a switch to the automatic mode is made or not based on the magnitude of the engine load.

In other words, the control portion 52 determines whether the position of the lever 5*a* is the neutral position or not in step S8. If the lever 5*a* is in the neutral position, the accelerator opening (the opening of the lever 5*a*) is zero, and the engine speed is the idling speed. Therefore, the engine load is not large, and thus the automatic mode is selected in step S11. Accordingly, the mode switch steps end.

If the lever 5*a* is not in the neutral position, the control portion 52 determines whether a switch between the modes is made or not based on the magnitude of the engine load. In other words, the control portion 52 determines whether the accelerator opening (the opening of the lever 5*a*) is equal to or less than the threshold value X or not in step S9. If the accelerator opening (the opening of the lever 5*a*) is equal to or less than the threshold value X, the control portion 52 determines whether the engine speed is equal to or less than the threshold value Y or not in step S10. If the accelerator opening is equal to or less than the threshold value X and the engine speed is equal to or less than the threshold value Y, the control portion 52 determines that the engine load is not large and selects the automatic mode in step S11. Accordingly, the mode switch steps end.

If the accelerator opening is larger than the threshold value X or the engine speed is larger than the threshold value Y, the control portion 52 determines that the engine load is large. The mode switch steps end without executing a switch to the automatic mode. A switch between the modes is executed as described above in the present preferred embodiment.

In various preferred embodiments described above, the driving force generated by the engine 31 can be transmitted to the propellers 32*a* and 32*b* when the transmission mechanism is shifted down. Accordingly, acceleration performance in the low speed position can be improved. Further, the driving force generated by the engine 31 can be transmitted to the propellers 32*a* and 32*b* in a state that the transmission mechanism is shifted up. This allows a larger maximum speed to be obtained. As a result, both the acceleration performance and the maximum speed can approach levels that the user desires. The user operates the gear shift switch 5*b* in the manual mode, and thereby can arbitrarily make the shift-down or shift-up operation in the forward and reverse travels.

In the various preferred embodiments described above, the threshold value of the engine speed arranged to inhibit the shift-down operation is determined based on the shift inhibition control map and the throttle opening. If the engine speed is larger than the threshold value, a control is made so that the shift-down operation is not executed. Thereby, the execution of the shift-down operation can be prevented when the user operates the gear shift switch 5*b* to the shift-down position in a state that the engine speed is large and thereby provides an instruction for the shift-down operation. Accordingly, the engine speed can be prevented from further increasing due to the execution of the shift-down operation in the state that the engine speed is large. This allows prevention of over-revving of the engine in the shift-down operation.

In the various preferred embodiments described above, the threshold value for the shift-down inhibition is set to decrease as the throttle opening of the engine becomes larger. Thereby, the execution of the shift-down operation can be prevented when the throttle opening is large and the engine output is large. Accordingly, the execution of the shift-down operation can be prevented when a large shift shock occurs due to the large engine output.

In the various preferred embodiments described above, the threshold value of the engine speed arranged to inhibit the shift-up operation is determined based on the shift inhibition control map and the throttle opening. If the engine speed is smaller than the threshold value, control is made so that the shift-up operation is not executed. Thereby, the execution of the shift-up operation can be prevented when the user operates the gear shift switch 5*b* to the shift-up position in a state that the engine speed is small and thereby provides an instruction for the shift-up operation. Accordingly, the engine speed can be prevented from further decreasing due to the shift-up operation in the state that the engine speed is small. Therefore, an engine stall can be prevented during the shift-up operation.

In the various preferred embodiments described above, the threshold value of the engine speed for the shift-up inhibition is set to become larger as the throttle opening of the engine 31 becomes larger in the range in which the throttle opening is relatively large. Thereby, the execution of the shift-up operation can be prevented when the throttle opening is large and the engine speed is small. The low speed reduction ratio is preferable to the high speed reduction ratio since torque is required when the throttle opening is large and the engine speed is small (such as a case when the propellers 32*a* or 32*b* is entangled with waterweeds, for example). The shift-up operation is inhibited in the state that torque is required, thereby allowing prevention of a torque decrease as a result of shift-up in the state that torque is required.

In the various preferred embodiments described above, the shift-down operation is again made when the decrease proportion of the engine speed after the shift-up operation to the engine speed before the shift-up operation is larger than a certain threshold value in the shift-up operation. Accordingly, the engine speed and the torque can be increased by shifting down when the engine speed largely decreases in the shift-up operation. This allows a prevention of an engine stall during the shift-up operation.

In the various preferred embodiments described above, the threshold value (decrease proportion of the engine speed) for the shift redirection is set to become larger as the engine speed becomes larger. Accordingly, the shift redirection (shift-up operation) is not made when the engine speed is large although the engine speed decreases substantially. An engine stall is not likely to occur when the engine speed is large, even if the decrease proportion of the engine speed is large. Accordingly, an engine stall can be prevented while the shift-up operation is made to reflect an intention of the user as accurately as possible.

In the various preferred embodiments described above, the mode switching lever 9 arranged to switch between the manual mode and the automatic mode is provided. Thereby, the user can freely make a switch between the manual mode and the automatic mode.

In the various preferred embodiments described above, a switch between the modes is executed when the accelerator opening (the opening of the lever 5*a*) is equal to or less than the threshold value X and the engine speed is equal to or less than the threshold value Y when the user operates the mode switching lever 9. This allows a prevention of sudden acceleration or deceleration due to states of the gear shift switch 5*b* and the lever 5*a* of the control lever section 5 when the user mistakenly operates the mode switch lever 9 in a state that the engine load is large.

It should be understood that the preferred embodiments disclosed in the foregoing are merely exemplary, and do not limit the present invention. It is intended that the scope of the present invention be defined not by the preferred embodiments discussed in the foregoing descriptions but solely by the appended claims. Further, the present invention includes all modifications within meanings equivalent to the claims and the scope thereof.

For example, in the above preferred embodiments, descriptions are made about a marine propulsion system including the two outboard motors in which the engine and the propellers are disposed outside of the hull as an exemplary case. However, the present invention is not limited to this case, and can be applied to other marine propulsion systems including a stern drive in which an engine is fixed to a hull and an inboard motor in which an engine and a propeller are fixed to a hull, for example. The present invention can also be applied to a marine propulsion system including a single outboard motor.

In the above preferred embodiments, descriptions are made about a case when the horizontal axis of the shift redirection control map represents the engine speed. However, the present invention is not limited to this case, and the horizontal axis may instead represent the throttle opening, for example.

In the above preferred embodiments, descriptions are made about a case when the horizontal axis of the shift control map (see FIG. 12) for the automatic mode represents the accelerator opening. However, the present invention is not limited to this case, and the horizontal axis may represent the throttle opening, in other words, the opening of the throttle valve provided in an intake passage of the engine, for example.

In the above preferred embodiments, descriptions are made about a case when a switch can be made between the manual mode and the automatic mode. However, the present invention is not limited to this case, and the mode may be fixed to the manual mode, for example.

In the above preferred embodiments, descriptions are made about a case when the gear shift switch 5*b* is provided as the operation portion that the user operates for a shift in the manual mode. However, the present invention is not limited to this case, and the operation portion may have any desirable form.

In the above preferred embodiments, descriptions are made about a case when the shift-up inhibition referential line U is set in a manner such that the engine speed becomes smaller as the throttle opening becomes larger in the range of the shift inhibition control map for small throttle opening. However, the present invention is not limited to this case, and the referential line U can be set so that the engine speed is a constant value (minimum value $N_M$) in the range for small throttle opening, for example. The minimum value $N_M$ of the shift-up inhibition referential line U may be set to a value larger than the idling speed $N_I$.

In the above preferred embodiments, descriptions are made about a marine propulsion system including an outboard motor having the two propellers as an exemplary case. However, the present invention is not limited to this case, and can be applied to other marine propulsion systems including an outboard motor having a single, three, or more propellers, for example.

In the above preferred embodiments, descriptions are made about a case when the maps (the shift inhibition control map and the shift redirection control map for the manual mode and the shift control map for the automatic mode) for the reverse travel of the boat have configurations similar to the maps for the forward travel of the boat. However, the present invention is not limited to this case. Two maps, in which one is dedicated to forward travel and the other is dedicated to reverse travel, could also be provided, for example.

In the above preferred embodiments, descriptions are made about a case when the control portion and the ECU are connected together by the common LAN cables and thereby communication can be made. However, the present invention is not limited to this case. Communication between the control portion and the ECU may be achieved by wireless communication, for example.

In the above preferred embodiments, the shift position signal is transmitted from the control portion to the ECU via only the common LAN cable 7. The accelerator opening signal is transmitted from the control portion to the ECU via only the common LAN cable 8. However, the present invention is not limited to this case. Both the shift position signal and the accelerator opening signal may be transmitted from the control portion to the ECU by the same common LAN cable, for example. Furthermore, the shift position signal may be transmitted from the control portion to the ECU via only the common LAN cable 8, or the accelerator opening signal may be transmitted from the control portion to the ECU via only the common LAN cable 7.

In the above preferred embodiments, the rotational speed of the crankshaft is used as an example of the engine speed. However, the present invention is not limited to this case. For example, the rotational speeds of members (shafts) other than the crankshaft that rotate together with rotation of the crankshaft in the engine such as propeller and output shaft may be used as the engine speed.

In the above preferred embodiments, descriptions are made about a case when the horizontal axis of the shift control map for the automatic mode represents the accelerator opening. However, the present invention is not limited to this case, but the horizontal axis may represent the throttle opening (the opening of the throttle valve provided in the intake passage of the engine), for example.

In the preferred embodiments described above, descriptions are made about a case when the two outboard motors are provided. However, the present invention is not limited to this case, but one, three, or more outboard motors may be provided, for example. In a case of having a plurality of outboard motors, timings for a shift or shift inhibition may be synchronized among all the outboard motors. In this case, one of the outboard motors is used as a main outboard motor, and thereby shift control may be made for the other outboard motors simultaneously with a shift control of the transmission mechanism of the main outboard motor. Specifically, the shift control may be made in the following manner. The control portion 52 outputs the "speed changing gear shift signal" or a "shift inhibition signal" to the ECU of the main outboard motor based on the shift control map and the shift inhibition control map stored in the memory portion 51 of the control lever section 5. The ECU of the main outboard motor outputs a "driving signal" or "non-driving state retaining signal" to its own electromagnetic hydraulic pressure control valve 37 based on the "speed changing gear shift signal" or "shift inhibition signal". Thereby, the upper transmission section 310 is shifted to the low speed position or inhibited from shifting. The ECU of the main outboard motor outputs the "driving signal" or "non-driving state retaining signal" to the ECUs installed in the other outboard motors via the common LAN. The ECUs of the other outboard motors output the "driving signal" or "non-driving state retaining signal" to their own electromagnetic hydraulic pressure control valves 37 based on the signals sent from the ECU of the main outboard motor. Thereby, the upper transmission section 310 of the main outboard motor and the upper transmission sections 310 of the outboard motors other than the main outboard motor are shifted to the low speed position or inhibited from shifting in a synchronized manner.

Each of the plurality of the outboard motors may output the shift control signal not only to its own transmission mechanism but also to the transmission mechanisms of the other outboard motors. In addition, each of the transmission mechanisms may make a shift based on the shift control signal sent the earliest among the shift control signals from the plurality of ECUs. Specifically, the shift control may be made in the following manner. The control portion 52 outputs the "speed changing gear shift signal" or a "shift inhibition signal" to the ECU of every outboard motor based on the shift control map and the shift inhibition control map stored in the memory portion 51 of the control lever section 5. The ECU of each of the outboard motors outputs the "driving signal" or "non-driving state retaining signal" to its own electromagnetic hydraulic pressure control valve 37 based on the "speed changing gear shift signal" or "shift inhibition signal" and at the same time outputs the "driving signal" or "non-driving state retaining signal" to the electromagnetic hydraulic pressure control valves 37 of the other outboard motors via the common LAN. A switch between a driving state and a non-driving state is made in the electromagnetic hydraulic pressure control valve 37 of each of the outboard motors based on the "driving signal" or "non-driving state retaining signal" most recently sent. Thereby, the upper transmission section 310 of each of the plurality of the outboard motors is shifted to the low speed position or inhibited from shifting in a synchronized manner. Further, in this case, an ECU other than the ECU 34 controlling the engine may be provided in the outboard motor. The maps may be stored in the ECU. The control signals may be output from the ECU.

As described above, when timings for shifts and shift inhibition are synchronized among all the outboard motors, the control portion 52 of the control lever section 5 outputs the "speed changing gear shift signal" or "shift inhibition signal" if any of the following conditions is satisfied. The control portion 52 outputs the "speed changing gear shift signal" or "shift inhibition signal" if an operating state of at least any one of the plurality of outboard motors satisfies a condition for a shift or shift inhibition or if the operating state of a particular outboard motor among the plurality of the outboard motors satisfies the condition for a shift or shift inhibition.

In the above preferred embodiments, descriptions are made about a case when the shift control map and the shift inhibition control map are stored in the memory portion 51 included in the control lever section 5 and the control signals for making the transmission mechanism 33 shift the reduction ratios is output from the control portion 52 included in the control lever section 5. However, the present invention is not limited to this case. The shift control map and the shift inhibition control map may be stored in the ECU 34 provided in the outboard motor, for example. In this case, the control signals may be output from the ECU 34 in which the shift control map and the shift inhibition control map are stored.

In the above preferred embodiments, descriptions are made about a case when the shift between forward, neutral, and reverse is made by the lower transmission section 330 electrically controlled by the ECU 34. However, the present invention is not limited to this case. For example, the shift between forward, neutral, and reverse may be made by a forward-reverse switching mechanism defined with a pair of bevel gear and dog clutch as disclosed in JP-A-Hei 9-263294.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A marine propulsion system comprising:

an engine;

a plurality of propellers that are rotated by the engine;

a transmission mechanism that operates in at least a lower speed reduction ratio and a higher speed reduction ratio, and transmits a driving force of the engine to the plurality of propellers with a speed thereof shifted to one of the lower speed reduction ratio and the higher speed reduction ratio during forward travel and reverse travel;

an operation portion that is operated by a user to shift the transmission mechanism to the lower speed reduction ratio at least during the reverse travel; and a control portion that controls a shift of the transmission mechanism between the lower speed reduction ratio and the higher speed reduction ratio; wherein the control portion does not execute a shift from the higher speed reduction ratio to the lower speed reduction ratio when an engine speed of the engine is larger than a first threshold value even though the user operates the operation portion to shift the transmission mechanism from the higher speed reduction ratio to the lower speed reduction ratio.

2. The marine propulsion system according to claim 1, wherein the operation portion is operated by the user to also shift the transmission mechanism to the lower speed reduction ratio during the forward travel.

3. The marine propulsion system according to claim 1, wherein the first threshold value decreases as a throttle opening of the engine increases.

4. The marine propulsion system according to claim 1, wherein the control portion determines the first threshold value for determining whether or not a shift between the lower and higher speed reduction ratios can be executed based on a first shift control map, in which a shift inhibition range that prohibits shifts between the lower and higher speed reduction ratios is made based on the engine speed and a throttle opening of the engine.

5. The marine propulsion system according to claim 4, wherein the first shift control map includes:

a shift-up inhibition range that inhibits a shift from the lower speed reduction ratio to the higher speed reduction ratio; and a shift-down inhibition range that inhibits a shift from the higher speed reduction ratio to the lower speed reduction ratio; and the control portion does not execute a shift between the lower and higher speed reduction ratios when the user operates the operation portion that shifts between the lower and higher speed reduction ratios and the engine speed and the throttle opening of the engine are in the shift-up inhibition range or the shift-down inhibition range.

6. A marine propulsion system comprising:

an engine;

a plurality of propellers that are rotated by the engine;

a transmission mechanism that operates in at least a lower speed reduction ratio and a higher speed reduction ratio, and transmits a driving force of the engine to the plurality of propellers with a speed thereof shifted to one of the lower speed reduction ratio and the higher speed reduction ratio during forward travel and reverse travel;

an operation portion that is operated by a user to shift the speed reduction ratio of the transmission mechanism to the lower speed reduction ratio at least during the reverse travel; and a control portion that controls a shift between the lower and higher speed reduction ratios of the transmission mechanism; wherein the control portion does not execute a shift from the lower speed reduction ratio to the higher speed reduction ratio when an engine speed of the engine is smaller than a first threshold value even though the user operates the operation portion to shift the transmission mechanism from the lower speed reduction ratio to the higher speed reduction ratio.

7. The marine propulsion system according to claim 6, wherein the first threshold value increases as a throttle opening of the engine increases.

8. The marine propulsion system according to claim 6, wherein the operation portion is operated by the user to also shift the transmission mechanism to the lower speed reduction ratio during the forward travel.

9. The marine propulsion system according to claim 6, wherein the control portion determines the first threshold value for determining whether or not a shift between the lower and higher speed reduction ratios can be executed based on a first shift control map, in which a shift inhibition range that prohibits shifts between the lower and higher speed reduction ratios is made based on the engine speed and a throttle opening of the engine.

10. The marine propulsion system according to claim 9, wherein the first shift control map includes:

a shift-up inhibition range that inhibits a shift from the lower speed reduction ratio to the higher speed reduction ratio; and a shift-down inhibition range that inhibits a shift from the higher speed reduction ratio to the lower speed reduction ratio; and the control portion does not execute a shift between the lower and higher speed reduction ratios when the user operates the operation portion to shift between the lower and higher speed reduction ratios and the engine speed and the throttle opening of the engine are in the shift-up inhibition range or the shift-down inhibition range.

11. A marine propulsion system comprising:

an engine;

a plurality of propellers that are rotated by the engine;

a transmission mechanism that operates in at least a lower speed reduction ratio and a higher speed reduction ratio, and transmits a driving force of the engine to the plurality of propellers with a speed thereof shifted to one of the lower speed reduction ratio and the higher speed reduction ratio during forward travel and reverse travel;

an operation portion that is operated by a user to shift the speed reduction ratio of the transmission mechanism to the lower speed reduction ratio at least during the reverse travel; and a control portion that controls a shift between the lower and higher speed reduction ratios of the transmission mechanism; wherein the control portion shifts from the higher speed reduction ratio back to the lower speed reduction ratio when a shift to the higher speed reduction ratio is made by the operation portion and a decreased in the engine speed after the shift compared to the engine speed before the shift is larger than a first threshold value when the engine speed decreases due to the shift to the higher speed reduction ratio.

12. The marine propulsion system according to claim 11, wherein the first threshold value is set so that the decreased amount of the engine speed increases as the engine speed increases.

13. The marine propulsion system according to claim 12, wherein the control portion controls the transmission mechanism so that the transmission mechanism again shifts between the lower and higher speed reduction ratios based on a first shift control map defining a shift redirection based on the decreased amount of the engine speed and the engine speed.

14. A marine propulsion system comprising:

an engine;

a plurality of propellers that are rotated by the engine;

a transmission mechanism that operates in at least a lower speed reduction ratio and a higher speed reduction ratio, and transmits a driving force of the engine to the plurality of propellers with a speed thereof shifted to one of the lower speed reduction ratio and the higher speed reduction ratio during forward travel and reverse travel;

an operation portion that is operated by a user to shift the speed reduction ratio of the transmission mechanism to the lower speed reduction ratio at least during the reverse travel;

a control portion that controls a shift between the lower and higher speed reduction ratios of the transmission mechanism;

a control lever section operated by a user to control driving of the engine; and a mode switching lever that switches between a first position corresponding to a manual mode in which the user can select the lower speed reduction ratio or the higher speed reduction ratio and a second position corresponding to an automatic mode in which the control portion can select the lower speed reduction ratio or the higher speed reduction ratio based on operation of the control lever section.

15. The marine propulsion system according to claim 14, wherein the control portion executes a mode switch if an opening of the control lever section is equal to or less than a first threshold value and the engine speed is equal to or less than a second threshold value when the user changes a position of the mode switching lever.

* * * * *